US011571898B2

(12) United States Patent
Takahagi et al.

(10) Patent No.: US 11,571,898 B2
(45) Date of Patent: Feb. 7, 2023

(54) LIQUID SUPPLY DEVICE, LIQUID DISCHARGE DEVICE, AND LIQUID DISCHARGE APPARATUS

(71) Applicant: Ricoh Company, Ltd., Tokyo (JP)

(72) Inventors: Hiroshi Takahagi, Kanagawa (JP); Masanao Yuza, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 75 days.

(21) Appl. No.: 17/352,895

(22) Filed: Jun. 21, 2021

(65) Prior Publication Data

US 2022/0024211 A1 Jan. 27, 2022

(30) Foreign Application Priority Data

Jul. 22, 2020 (JP) ..... JP2020-125445

(51) Int. Cl.
*B41J 2/18* (2006.01)
*B41J 2/165* (2006.01)

(52) U.S. Cl.
CPC ..... *B41J 2/16517* (2013.01); *B41J 2/18* (2013.01)

(58) Field of Classification Search
CPC ..... B41J 2/18
See application file for complete search history.

(56) References Cited

U.S. PATENT DOCUMENTS

| | | | | |
|---|---|---|---|---|
| 11,148,932 | B2 * | 10/2021 | Azami | B41J 2/18 |
| 2002/0057304 | A1 | 5/2002 | Akiyama et al. | |
| 2002/0126186 | A1 | 9/2002 | Takahagi et al. | |
| 2002/0171715 | A1 | 11/2002 | Takahagi et al. | |
| 2002/0180844 | A1 | 12/2002 | Takahagi et al. | |
| 2006/0278577 | A1 * | 12/2006 | Yamamoto | B41J 2/175 210/512.1 |
| 2007/0296135 | A1 | 12/2007 | Takahagi et al. | |
| 2014/0063138 | A1 | 3/2014 | Takahagi et al. | |
| 2020/0247665 | A1 | 8/2020 | Azami et al. | |

FOREIGN PATENT DOCUMENTS

| | | |
|---|---|---|
| JP | 2002-273867 | 9/2002 |
| JP | 2014-240035 | 12/2014 |

* cited by examiner

*Primary Examiner* — Sharon Polk
(74) *Attorney, Agent, or Firm* — Xsensus LLP

(57) ABSTRACT

A liquid supply device includes a collection sub tank and a collection flow path. The collection sub tank collects liquid from a liquid discharge head. The collection flow path connects the liquid discharge head and the collection sub tank. The collection sub tank includes a first inflow port connected with the collection flow path and a first inner wall portion on an extension line extending from the first inflow port in a direction in which the liquid flows into the collection sub tank from the collection flow path. The first inner wall portion has one of an inclined surface inclined with respect to the extension line, an arc-shaped surface, and a curved surface.

10 Claims, 15 Drawing Sheets

LIQUID SUPPLY DEVICE, LIQUID DISCHARGE DEVICE, AND LIQUID DISCHARGE APPARATUS

CROSS-REFERENCE TO RELATED APPLICATION

This patent application is based on and claims priority pursuant to 35 U.S.C. § 119(a) to Japanese Patent Application No. 2020-125445, filed on Jul. 22, 2020, in the Japan Patent Office, the entire disclosure of which is hereby incorporated by reference herein.

BACKGROUND

Technical Field

Aspects of the present disclosure relate to a liquid supply device, a liquid discharge device, and a liquid discharge apparatus.

Description of the Related Art

A recording apparatus of an ink discharge type (inkjet recording apparatus or liquid discharge apparatus) includes a liquid discharge head and is used as an image forming apparatus such as a printer, a facsimile, a copier, a plotter, and a multifunction peripheral having at least two of such capabilities. As an example of the liquid discharge head, there is known a circulatory head that includes supply channels communicating with individual liquid chambers, which communicate with nozzles, and ejection channels communicating with the individual liquid chambers. The circulatory head further includes liquid supply ports communicating with the supply channels and liquid ejection ports communicating with the ejection channels.

SUMMARY

Embodiments of the present disclosure describe an improved liquid supply device that includes a collection sub tank and a collection flow path. The collection sub tank collects liquid from a liquid discharge head. The collection flow path connects the liquid discharge head and the collection sub tank. The collection sub tank includes a first inflow port that connected with the collection flow path and a first inner wall portion on an extension line extending from the first inflow port in a direction in which the liquid flows into the collection sub tank from the collection flow path. The first inner wall portion has one of an inclined surface inclined with respect to the extension line, an arc-shaped surface, and a curved surface.

BRIEF DESCRIPTION OF THE SEVERAL VIEWS OF THE DRAWINGS

Amore complete appreciation of the disclosure and many of the attendant advantages thereof will be readily obtained as the same becomes better understood by reference to the following detailed description when considered in connection with the accompanying drawings, wherein.

Figure 1:
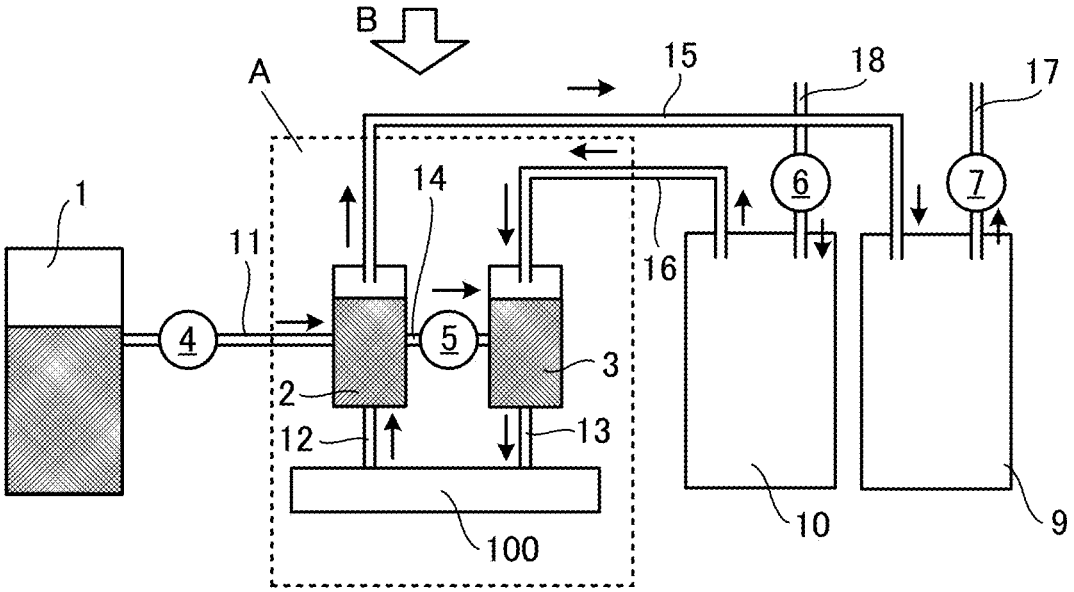
FIG. 1 is a schematic view illustrating a configuration of a liquid supply device according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

Hereinafter, a liquid supply device, a liquid discharge device, and a liquid discharge apparatus according to embodiments of the present disclosure are described with reference to the drawings. It is to be noted that the following embodiments are not limiting the present disclosure and any deletion, addition, modification, change, etc. can be made within a scope in which person skilled in the art can conceive including other embodiments, and any of which is included within the scope of the present disclosure as long as the effect and feature of the present disclosure are demonstrated.

Figure 2:
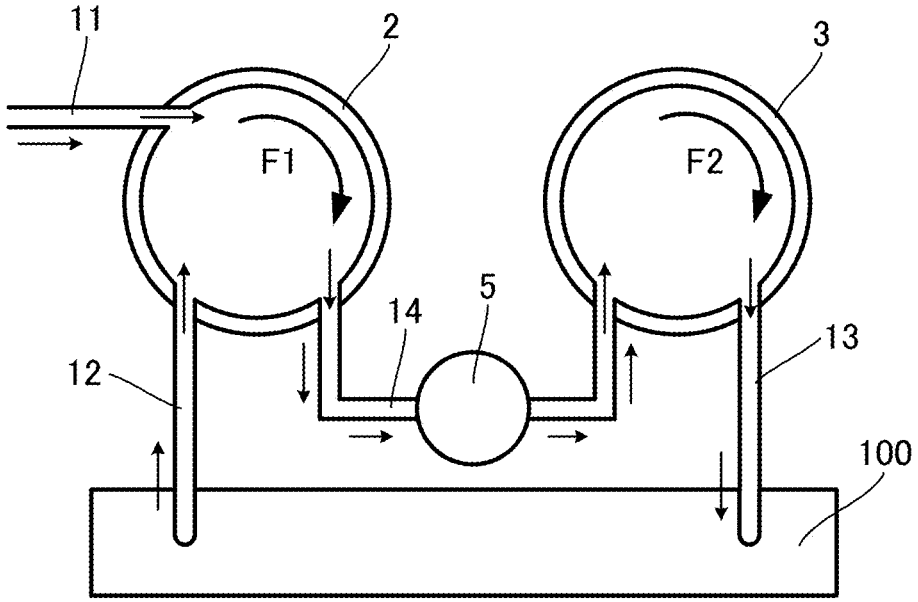
FIG. 2 is a schematic cross-sectional view of a part of the liquid supply device inside area A in FIG. 1 as viewed in a direction indicated by arrow B in FIG. 1.
Figure 6:
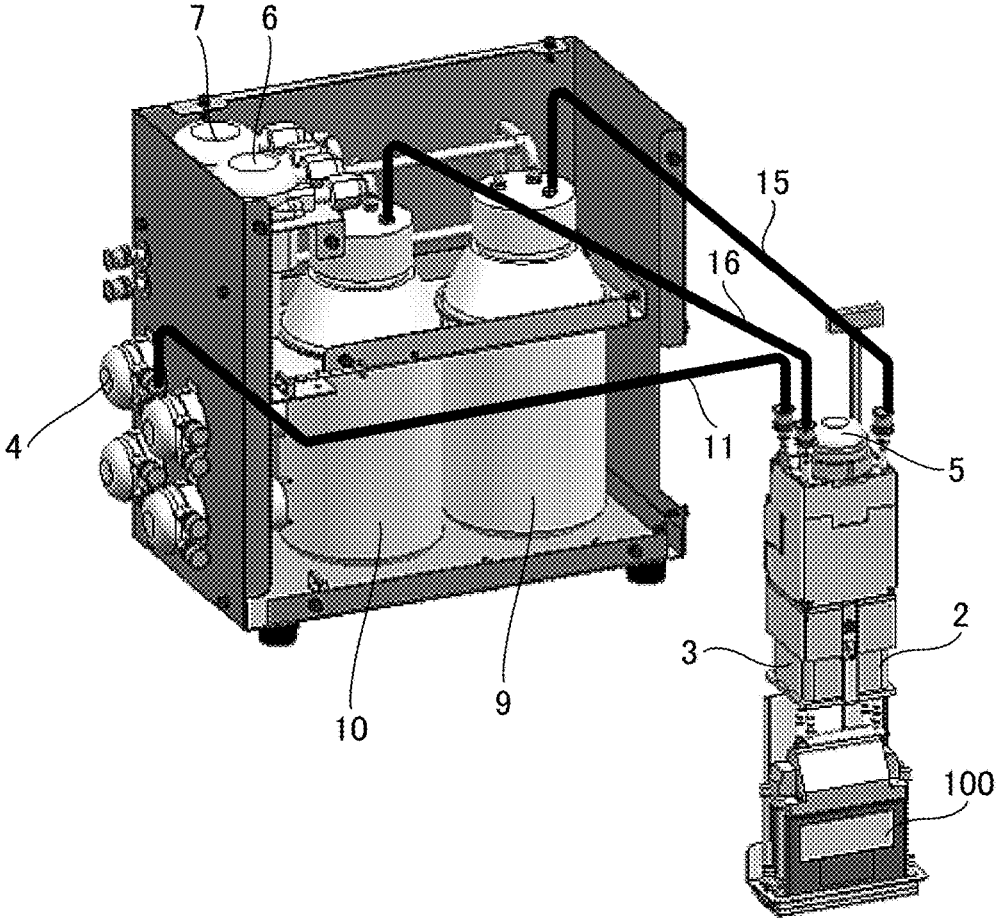
FIG. 6 is an exterior perspective view illustrating an example of the liquid supply device according to an embodiment of the present disclosure.

FIG. 1 is a schematic view illustrating a configuration of a liquid supply device to which the present disclosure can be applied. FIG. 2 is a schematic cross-sectional view of a part of the liquid supply device inside area A in FIG. 1 as viewed in the direction indicated by arrow B in FIG. 1. FIG. 6 is an exterior perspective view illustrating an example of the liquid supply device according to the present disclosure. Arrows in the drawings indicate the direction of flow of liquid or gas.

As illustrated in FIGS. 1 and 6, the liquid supply device according to the present embodiment includes a main tank 1, a sub tank including a collection sub tank 2 and a supply sub tank 3, and an air tank including a negative pressure air tank 9 and a positive pressure air tank 10. The main tank 1 stores liquid to be supplied to a liquid discharge head 100. The sub tank stores at least gas and communicates with the main tank 1 and the liquid discharge head 100. The air tank stores gas and communicates with the sub tank. The liquid discharge head 100 discharge liquid. The sub tank includes the supply sub tank (positive pressure sub tank) 3 that supplies liquid to the liquid discharge head 100, and the collection sub tank (negative pressure sub tank) 2 that collects the liquid from the liquid discharge head 100. In the present embodiment, the main tank 1 is connected to the collection sub tank 2.

Figure 3A:
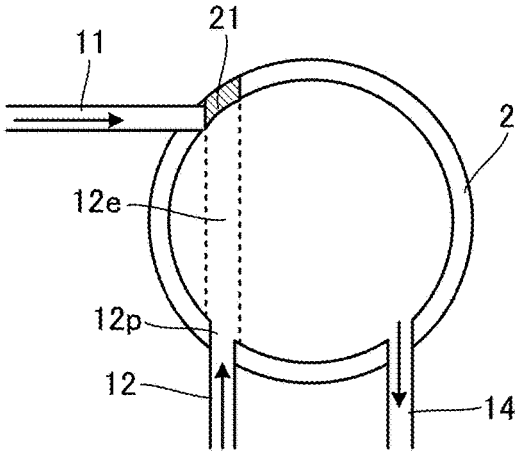
FIGS. 3A to 3D are schematic views of a collection sub tank of the liquid supply device illustrated in FIG. 2.
Figure 3B:
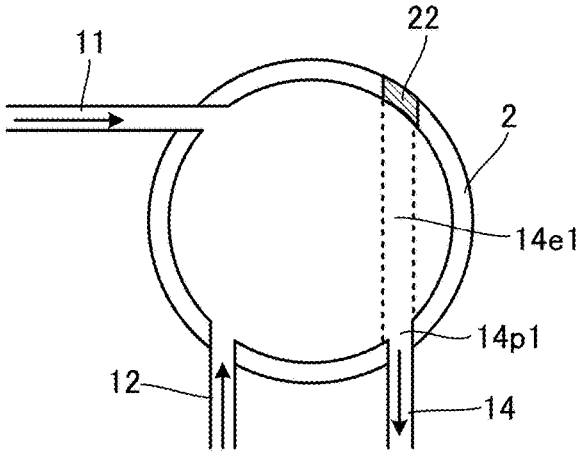
Figure 3C:
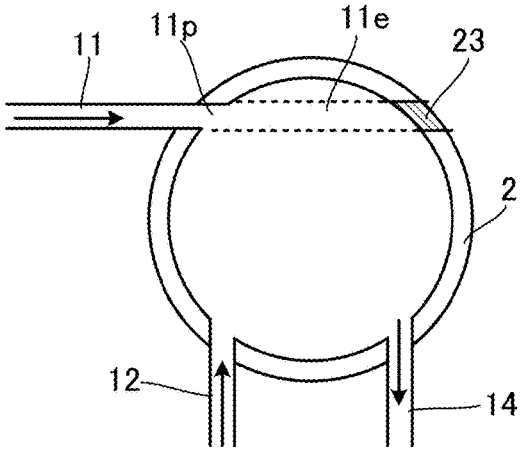
Figure 3D:
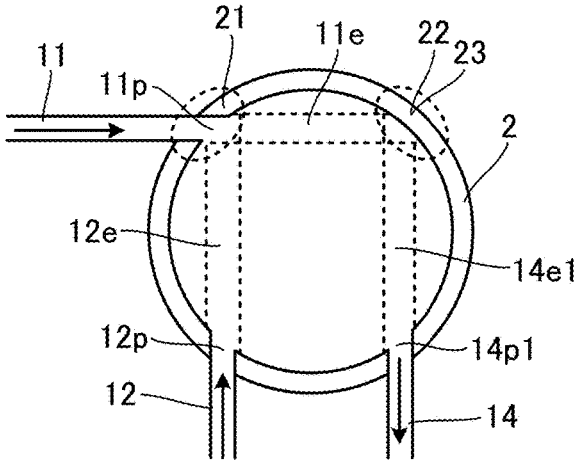
Figure 4A:
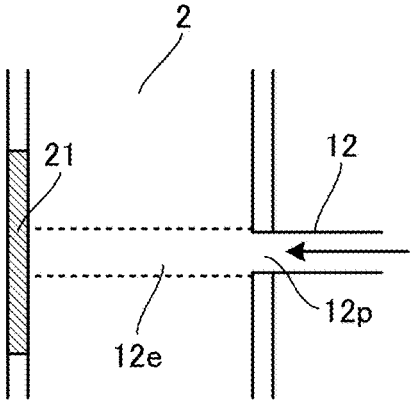
FIGS. 4A and 4B are schematic cross-sectional views of the collection sub tank as viewed from a lateral side thereof.
Figure 4B:
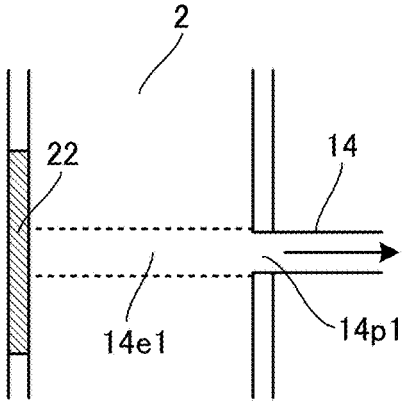

FIGS. 3A to 3D and 4A to 4B illustrate the collection sub tank 2. Similarly to FIG. 2, FIGS. 3A to 3D are schematic cross-sectional views of the collection sub tank 2 as viewed in the direction indicated by arrow B in FIG. 1. FIGS. 4A and 4B are schematic cross-sectional views of the collection sub tank 2 as viewed in the lateral direction perpendicular to the direction indicated by arrow B.

As illustrated in FIG. 3A, the liquid supply device according to the present embodiment includes the collection sub tank 2 that is connected to the liquid discharge head 100 and collects liquid from the liquid discharge head 100, and a collection flow path 12 that connects the liquid discharge head 100 and the collection sub tank 2. The collection sub tank 2 includes a collection flow path inlet (first inflow port) 12*p* and a first inner wall portion 21. The collection flow path inlet (first inflow port) 12*p* of the collection sub tank 2 is connected with the collection flow path 12. The first inner wall portion 21 faces the collection flow path inlet (first inflow port) 12*p* and is located on an extension line 12*e* extending in a liquid inflow direction in which liquid flows into the collection sub tank 2 from the collection flow path 12. The first inner wall portion 21 has one of an inclined surface inclined with respect to the extension line 12*e*, an arc-shaped surface, and a curved surface.

As illustrated in FIG. 4A, the first inner wall portion 21 is an area of an inner wall of the collection sub tank 2 that is located on the extension line 12*e* extending in the liquid inflow direction from the collection flow path 12 and facing the collection flow path inlet 12*p*. The collection flow path 12 is disposed, but not limited to, in the horizontal direction (substantially perpendicular to the surface of the inner wall) as illustrated in FIG. 4A. Alternatively, the collection flow path 12 may be inclined with respect to the horizontal direction.

Further, as illustrated in FIG. 3B, in the liquid supply device according to the present embodiment, the collection sub tank 2 includes a circulation flow path outlet (outflow port) 14*p*1 and a second inner wall portion 22. liquid flows out of the collection sub tank 2 through the circulation flow path outlet (outflow port) 14*p*1. The second inner wall portion 22 faces the circulation flow path outlet (outflow port) 14*p*1 and is located on an extension line 14*e*1 in a direction opposite a liquid outflow direction in which liquid flows out of the collection sub tank 2 through the circulation flow path outlet (outflow port) 14*p*1. The second inner wall portion 22 has one of an inclined surface inclined with respect to the extension line 14*e*1, an arc-shaped surface, and a curved surface.

As illustrated in FIG. 4B, the second inner wall portion 22 is an area of the inner wall of the collection sub tank 2 that is located on the extension line 14*e*1 in the direction opposite the liquid outflow direction into a circulation flow path 14 and facing the circulation flow path outlet 14*p*1. The circulation flow path 14 is disposed, but not limited to, in the horizontal direction (substantially perpendicular to the surface of the inner wall) as illustrated in FIG. 4B. Alternatively, the circulation flow path 14 may be inclined with respect to the horizontal direction.

Further, as illustrated in FIG. 3C, in the liquid supply device according to the present embodiment, the collection sub tank 2 includes a liquid supply path inlet (second inflow port) 11*p* and a third inner wall portion 23. liquid to be supplied flows into the collection sub tank 2 through the liquid supply path inlet (second inflow port) 11*p*. The third inner wall portion 23 faces the liquid supply path inlet (second inflow port) 11*p* and is located on an extension line 11*e* extending in a liquid inflow direction in which liquid flows into the collection sub tank 2 through the liquid supply path inlet (second inflow port) 11*p*. The third inner wall portion 23 has one of an inclined surface inclined with respect to the extension line 11*e*, an arc-shaped surface, and a curved surface.

The liquid supplied to the collection sub tank 2 is, for example, the liquid supplied from the main tank 1. The third inner wall portion 23 is an area of the inner wall of the collection sub tank 2 that is located on the extension line 11*e* of a liquid supply path 11 and facing the liquid supply path inlet 11*p*. As illustrated in FIG. 3D, in the collection sub tank 2 of the liquid supply device according to the present embodiment, the second inner wall portion 22 and the third inner wall portion 23 share a common area. Further, as illustrated in FIG. 3D, the liquid supply path inlet (second inflow port) 11*p* is disposed on the first inner wall portion 21. In the aspect in which the collection sub tank 2 is connected to the main tank 1, the liquid supply path inlet (second inflow port) 11*p* of the collection sub tank 2 is connected with the liquid supply path 11 and is disposed on the first inner wall portion 21. liquid supplied from the main tank 1 flows into the collection sub tank 2 through the liquid supply path 11.

With such a configuration, in the liquid supply device according to the present embodiment, liquid that flows and collides with the inner wall of the collection sub tank 2 forms a swirling liquid flow indicated by arrow F1 as illustrated in FIG. 2. Therefore, this configuration does not need a stirring mechanism that stirs the liquid circulating in the collection sub tank 2, thereby reducing the size of the device. Further, this configuration can prevent agglomeration and sedimentation of the component of the liquid.

That is, the liquid flows into the collection sub tank 2 from the collection flow path 12, collides with the first inner wall portion 21 facing the collection flow path inlet 12*p*, and forms the liquid flow indicated by arrow F1 in FIG. 2. The liquid flow is directed toward the circulation flow path outlet 14*p*1 of the collection sub tank 2 connected with the circulation flow path 14. Similarly, the liquid flows into the collection sub tank 2 from the liquid supply path 11, collides with the third inner wall portion 23 facing the liquid supply path inlet 11*p*, and forms the liquid flow indicated by arrow F1 in FIG. 2. The liquid flow is directed toward the circulation flow path outlet 14*p*1 of the collection sub tank 2 connected with the circulation flow path 14. In addition, the second inner wall portion 22 facing the circulation flow path outlet 14*p*1 has one of an inclined surface inclined with respect to the extension line 14*e*1, an arc-shaped surface, and a curved surface. Thus, the liquid flow is likely to be guided to the circulation flow path outlet 14*p*1.

In the liquid supply device according to the present embodiment, the second inner wall portion 22 and the third inner wall portion 23 share the common area. Therefore, the liquid that flows into the collection sub tank 2 from the liquid supply path 11 strengthens the liquid flow that flows out of the collection sub tank 2 into the circulation flow path 14 at the second inner wall portion 22 facing the circulation flow path outlet 14*p*1. Thus, the swirling liquid flow indicated by arrow F1 in FIG. 2 is effectively formed and guided to the circulation flow path outlet 14*p*1.

Further, in the liquid supply device according to the present embodiment, the liquid supply path inlet 11*p* of the collection sub tank 2 is connected with the liquid supply path 11 and disposed on the first inner wall portion 21. liquid is supplied from main tank 1 into the collection sub tank 2 through the liquid supply path 11. Therefore, the liquid that flows into the collection sub tank 2 from the liquid supply path 11 strengthens the liquid flow that flows into the collection sub tank 2 from the collection flow path 12 and collides with the first inner wall portion 21. Thus, the swirling liquid flow indicated by arrow F1 in FIG. 2 is effectively formed.

As illustrated in FIG. 2, the liquid supply device according to the present embodiment includes the supply sub tank 3 that is connected to the liquid discharge head 100 and supplies liquid to the liquid discharge head 100, and a supply flow path 13 that connects the liquid discharge head 100 and the supply sub tank 3.

Figure 5:
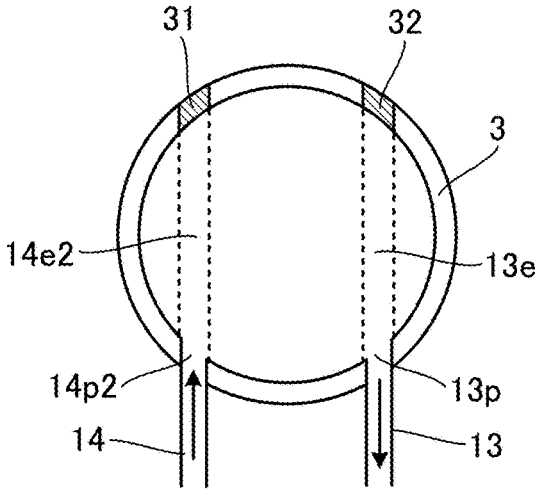
FIG. 5 is a schematic view of a supply sub tank of the liquid supply device illustrated in FIG. 2.

FIG. 5 is a schematic view of the supply sub tank 3 illustrated in FIG. 2. As illustrated in FIG. 5, in the liquid supply device according to the present embodiment, the supply sub tank 3 includes a supply flow path outlet (outflow port) 13*p* and a fourth inner wall portion 32. The supply flow path outlet (outflow port) 13*p* of the supply sub tank 3 is connected with the supply flow path 13. The fourth inner wall portion 32 faces the supply flow path outlet (outflow port) 13*p* and is located on an extension line 13*e* extending in a direction opposite a liquid outflow direction in which liquid flows out of the supply sub tank 3 into the supply flow path 13. The fourth inner wall portion 32 has one of an inclined surface inclined with respect to the extension line 13*e*, an arc-shaped surface, and a curved surface. The fourth inner wall portion 32 is an area of the inner wall of the supply sub tank 3 that is located on the extension line 13*e* of the supply flow path 13 and facing the supply flow path outlet 13*p*.

As illustrated in FIG. 2, the liquid supply device according to the present embodiment includes the circulation flow path 14 that connects the supply sub tank 3 and the collection sub tank 2. The supply sub tank 3 includes a circulation flow path inlet (inflow port) 14*p*2 and a fifth inner wall portion 31. liquid supplied from the collection sub tank 2 flows into the supply sub tank 3 through the circulation flow path inlet (inflow port) 14*p*2. The fifth inner wall portion 31 faces the circulation flow path inlet (inflow port) 14*p*2 and is located on an extension line 14*e*2 extending in a liquid inflow direction in which liquid flows into the supply sub tank 3 through the circulation flow path inlet (inflow port) 14*p*2. The fifth inner wall portion 31 has one of an inclined surface inclined with respect to the extension line 14*e*2, an arc-shaped surface, and a curved surface. The fifth inner wall portion 31 is an area of the inner wall of the supply sub tank 3 that is located on the extension line 14*e*2 of the circulation flow path 14 and facing the circulation flow path inlet 14*p*2.

With such a configuration, in the liquid supply device according to the present embodiment, liquid that flows and collides with the inner wall of the supply sub tank 3 forms a swirling liquid flow indicated by arrow F2 as illustrated in FIG. 2. Therefore, this configuration does not need a stirring mechanism that stirs the liquid circulating in the supply sub tank 3, thereby reducing the size of the device. Further, this configuration can prevent agglomeration and sedimentation of the component of the liquid.

That is, the liquid flows into the supply sub tank 3 from the circulation flow path 14, collides with the fifth inner wall portion 31 facing the circulation flow path inlet 14*p*2, and forms the liquid flow indicated by arrow F2 in FIG. 2. The liquid flow is directed toward the supply flow path outlet 13*p* of the supply sub tank 3 connected with the supply flow path 13. In addition, the fourth inner wall portion 32 facing the supply flow path outlet 13*p* has one of an inclined surface inclined with respect to the extension line 13*e*, an arc-shaped surface, and a curved surface. Thus, the liquid flow is likely to be guided to the supply flow path outlet 13*p*.

In the collection sub tank 2 and the supply sub tank 3, at least the first inner wall portion 21, the second inner wall portion 22, the third inner wall portion 23, the fifth inner wall portion 31, and the fourth inner wall portion 32 have one of an inclined surface, an arc-shaped surface, and a curved surface. Preferably, the entire collection sub tank 2 and the entire supply sub tank 3 are cylindrical.

The air tank includes the positive pressure air tank 10 and the negative pressure air tank 9. The positive pressure air tank 10 is connected to the supply sub tank 3 and applies positive air pressure to the supply sub tank 3. The negative pressure air tank 9 is connected to the collection sub tank 2 and applies negative air pressure to the collection sub tank 2.

As illustrated in FIGS. 1 and 6, the liquid supply device according to the present embodiment includes the liquid supply path 11, a liquid supply pump 4, the circulation flow path 14, a liquid circulation pump 5, the collection flow path 12, and the supply flow path 13. The liquid supply path 11 connects the main tank 1 and the collection sub tank 2. The liquid supply pump 4 feeds liquid from the main tank 1. The circulation flow path 14 connects the supply sub tank 3 and the collection sub tank 2. The liquid circulation pump 5 feeds liquid from the collection sub tank 2 to the supply sub tank 3. The collection flow path 12 connects the collection sub tank 2 and the liquid discharge head 100. The supply flow path 13 connects the supply sub tank 3 and the liquid discharge head 100.

The liquid supply device illustrated in FIGS. 1 and 6 further includes a first negative pressure air path 15, a negative pressure air pump 7, a second negative pressure air path 17, a first positive pressure air path 16, a positive pressure air pump 6, and a second positive pressure air path 18. The first negative pressure air path 15 connects the collection sub tank 2 and the negative pressure air tank 9. The negative pressure air pump 7 depressurizes the negative pressure air tank 9. The second negative pressure air path 17 communicates with the negative pressure air tank 9 and is connected to the negative pressure air pump 7. The first positive pressure air path 16 connects the supply sub tank 3 and the positive pressure air tank 10. The positive pressure air pump 6 pressurizes the positive pressure air tank 10. The second positive pressure air path 18 communicates with the positive pressure air tank 10 and is connected to the positive pressure air pump 6.

The volume of the air tank (i.e., the positive pressure air tank 10 and the negative pressure air tank 9) is preferably larger than the volume of the sub tank (i.e., the supply sub tank 3 and the collection sub tank 2). Specifically, the volume of the air tank (the positive pressure air tank 10 and the negative pressure air tank 9) can be appropriately selected according to the type of the device to be mounted and the volume of the sub tank. For example, when the sub tank stores 20 mL liquid, the volume of the air tank is preferably equal to or greater than 50 mL. In this case, if the volume of the air tank is less than 50 mL, a damper effect of the air tank is not sufficiently obtained.

As described above, in the liquid supply device according to the present embodiment, the supply sub tank 3 and the collection sub tank 2, which are downsized, are disposed above the liquid discharge head 100, and the positive pressure air tank 10 and the negative pressure air tank 9, which have large capacities, are disposed at positions separate from the supply sub tank 3 and the collection sub tank 2 as separate components, respectively. On the other hand, in another example of the liquid supply device illustrated in FIG. 8, the collection sub tank 2 and the negative pressure air pump 7 are directly connected to each other without the air tank, and similarly, the supply sub tank 3 and the positive pressure air pump 6 are also directly connected to each other without the air tank. Therefore, when liquid (e.g., ink) is supplied, the pressure fluctuation of the liquid may become large.

Figure 7:
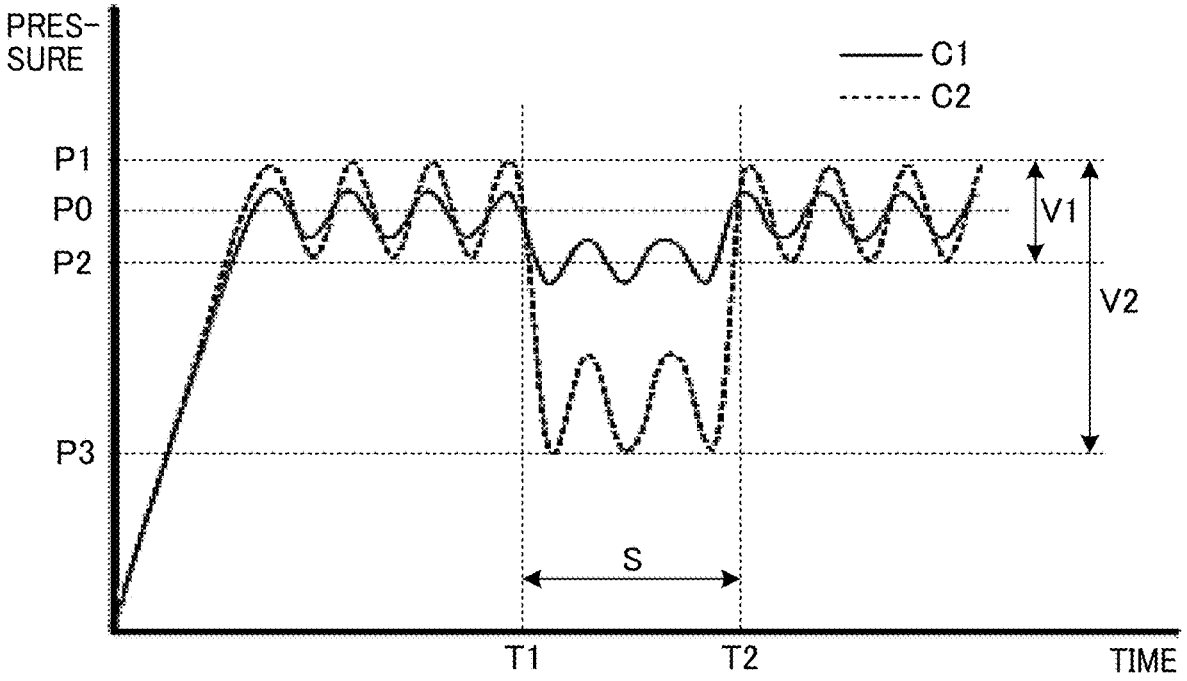
FIG. 7 is a graph conceptually illustrating a difference in pressure fluctuation between when an air tank is connected and when not.
Figure 8:
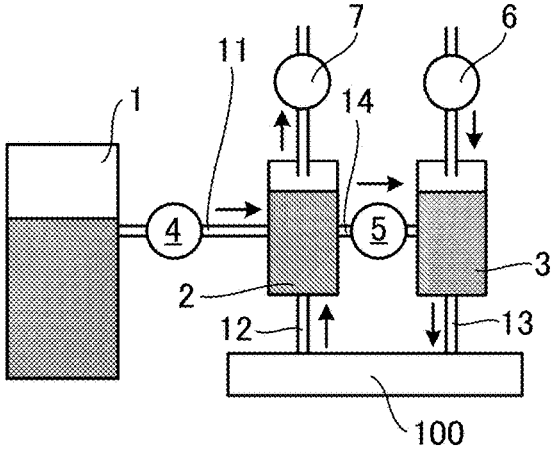
FIG. 8 is a schematic view illustrating another example of the liquid supply device.

FIG. 7 illustrates a difference in the pressure fluctuation between the aspect in which the air tank according to the present embodiment is connected to the sub tank as illustrated in FIG. 1 and the aspect in which the air tank is not connected as illustrated in FIG. 8. FIG. 7 is a graph conceptually illustrating the fluctuation of a liquid pressure in the collection flow path 12 connecting the collection sub tank 2 and the liquid discharge head 100 and the supply flow path 13 connecting the supply sub tank 3 and the liquid discharge head 100. The solid line C1 represents the present embodiment, the broken line C2 represents the example without the air tank.

In FIG. 7, a circulation pressure of liquid is set to a set value P0. In the example without the air tank, the liquid pressure fluctuates in a pressure pulsation range V1 between pressure P1 and pressure P2 when the liquid is circulated through the liquid discharge head 100, and the liquid pressure fluctuates in a pressure change range V2 between pressure P1 and pressure P3 when the liquid is discharged from the liquid discharge head 100. As illustrated in FIG. 7, in the example illustrated in FIG. 8, in which the air tank is not connected, indicated by the broken line C2, the liquid pressure greatly fluctuates in the pressure change range V2 exceeding the pressure pulsation range V1 in a period S from a time T1 when the liquid discharge head 100 starts discharging liquid to a time T2 when the liquid discharge head 100 stops discharging the liquid. On the other hand, according to the present embodiment indicated by the solid line C1, both the pressure change range when the liquid is discharged and the pressure pulsation range when the liquid is circulated are reduced as compared with the example without the air tank.

As described above, in the liquid supply device according to the present embodiment, the sub tank (the supply sub tank 3 and the collection sub tank 2) and the air tank (the positive pressure air tank 10 and the negative pressure air tank 9) are connected to each other. Accordingly, the apparent gas volume in the sub tank becomes the sum of the volumes of the gas in the sub tank and the gas in the air tank that has the large capacity. Therefore, a large air damper effect can be obtained, thereby reducing the pressure change range when the liquid is discharged by the liquid discharge head 100 and the pressure pulsation range when the liquid is circulated by the pumps.

Figure 9:
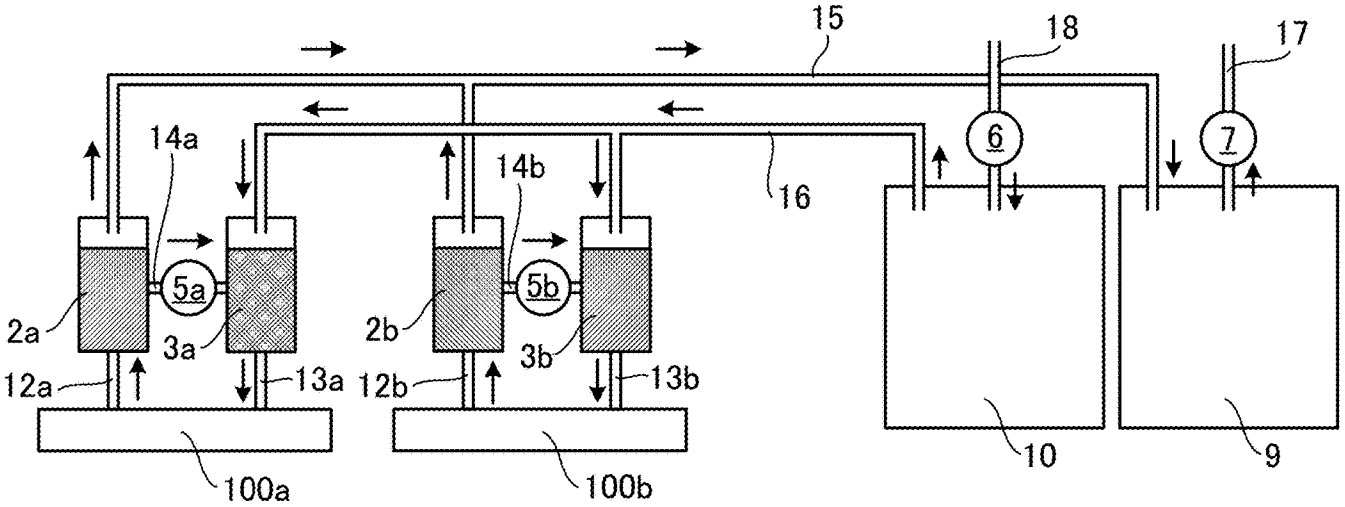
FIG. 9 is a schematic view illustrating a configuration of a liquid supply device according to a second embodiment of the present disclosure.

FIG. 9 is a schematic view illustrating a configuration of a liquid supply device according to a second embodiment of the present disclosure. Arrows in the drawings indicate the direction of flow of liquid or gas. The liquid supply device according to the present disclosure is not limited to the configuration illustrated in FIG. 1. As illustrated in FIG. 9, the liquid supply device may include multiple supply sub tanks 3*a* and 3*b* communicating with each other, the positive pressure air tank 10 connected to the multiple supply sub tanks 3*a* and 3*b*, multiple collection sub tanks 2*a* and 2*b* communicating with each other, and the negative pressure air tank 9 connected to the multiple collection sub tanks 2*a* and 2*b*. In each of the multiple collection sub tanks 2*a* and 2*b* and the multiple supply sub tanks 3*a* and 3*b*, liquid flowing in the sub tank collides with the inner wall of the sub tank and forms the swirling liquid flow, thereby preventing agglomeration and sedimentation of the component of the liquid.

Specifically, the liquid supply device illustrated in FIG. 9 includes the main tank 1, multiple liquid discharge heads 100*a* and 100*b*, the multiple collection sub tanks 2*a* and 2*b*, the multiple supply sub tanks 3*a* and 3*b*, the positive pressure air tank 10 connected to the supply sub tanks 3*a* and 3*b*, and the negative pressure air tank 9 connected to the collection sub tanks 2*a* and 2*b*.

The liquid supply device illustrated in FIG. 9 further includes circulation flow paths 14*a* and 14*b*, liquid circulation pumps 5*a* and 5*b*, collection flow paths 12*a* and 12*b*, and supply flow paths 13*a* and 13*b*. The circulation flow path 14*a* connects the supply sub tank 3*a* and the collection sub tank 2*a*. The circulation flow path 14*b* connects the supply sub tank 3*b* and the collection sub tank 2*b*. The liquid circulation pump 5*a* feeds liquid from the collection sub tank 2*a* to the supply sub tank 3*a*. The liquid circulation pump 5*b* feeds liquid from the collection sub tank 2*b* to the supply sub tank 3*b*. The collection flow path 12*a* connects the collection sub tank 2*a* and the liquid discharge head 100*a*. The collection flow path 12*b* connects the collection sub tank 2*b* and the liquid discharge head 100*b*. The supply flow path 13*a* connects the supply sub tank 3*a* and the liquid discharge head 100*a*. The supply flow path 13*b* connects the supply sub tank 3*b* and the liquid discharge head 100*b*.

The liquid supply device illustrated in FIG. 9 further includes the first negative pressure air path 15, the negative pressure air pump 7, the second negative pressure air path 17, the first positive pressure air path 16, the positive pressure air pump 6, and the second positive pressure air path 18. The first negative pressure air path 15 connects the collection sub tanks 2*a* and 2*b* and the negative pressure air tank 9. The negative pressure air pump 7 depressurizes the negative pressure air tank 9. The second negative pressure air path 17 communicates with the negative pressure air tank 9 and is connected to the negative pressure air pump 7. The first positive pressure air path 16 connects the supply sub tanks 3*a* and 3*b* and the positive pressure air tank 10. The positive pressure air pump 6 pressurizes the positive pressure air tank 10. The second positive pressure air path 18 communicates with the positive pressure air tank 10 and is connected to the positive pressure air pump 6.

As described above, even when the multiple sub tanks are provided, the air tank connected to the multiple sub tanks can increases the apparent air volume in each sub tank. Therefore, the air damper effect can be obtained, thereby reducing the pressure change range when the liquid is discharged by the liquid discharge head and the pressure pulsation range when the liquid is circulated by the pumps.

Figure 10:
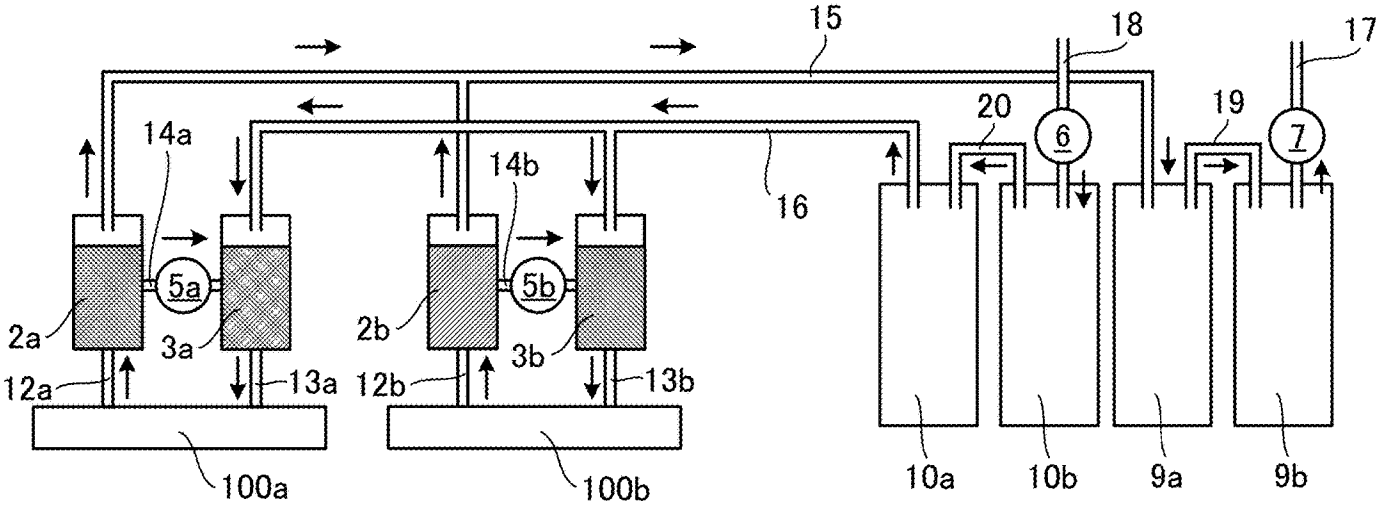
FIG. 10 is a schematic view illustrating a configuration of a liquid supply device according to a third embodiment of the present disclosure.

FIG. 10 is a schematic view illustrating a configuration of a liquid supply device according to a third embodiment of the present disclosure. Arrows in the drawings indicate the direction of flow of liquid or gas. The liquid supply device according to the present disclosure may include the multiple supply sub tanks 3*a* and 3*b* communicating with each other, a plurality of positive pressure air tanks 10*a* and 10*b* connected to the multiple supply sub tanks 3*a* and 3*b*, the multiple collection sub tanks 2*a* and 2*b* communicating with each other, and a plurality of negative pressure air tanks 9*a* and 9*b* connected to the multiple collection sub tanks 2*a* and 2*b*.

A method of connecting the multiple sub tanks and the plurality of air tanks described above may be any one of series connection and parallel connection, and may be appropriately selected according to a required capacity or design restrictions of the device. For example, as illustrated in FIG. 10, the liquid supply device may include the multiple supply sub tanks 3*a* and 3*b* communicating with each other in parallel, the plurality of positive pressure air tanks 10*a* and 10*b* connected to the multiple supply sub tanks 3*a* and 3*b*, the multiple collection sub tanks 2*a* and 2*b* communicating with each other in parallel, and the plurality of negative pressure air tanks 9*a* and 9*b* connected to the multiple collection sub tanks 2*a* and 2*b*. The positive pressure air tanks 10*a* and 10*b* are connected to each other in series. The negative pressure air tanks 9*a* and 9*b* are connected to each other in series. Connecting the plurality of air tanks in series is preferable from the viewpoint of downsizing because it is possible to reduce the number and length of paths between the sub tanks and air tanks.

In each of the multiple collection sub tanks 2*a* and 2*b* and the multiple supply sub tanks 3*a* and 3*b*, liquid flowing in the sub tank collides with the inner wall of the sub tank and forms the swirling liquid flow, thereby preventing agglomeration and sedimentation of the component of the liquid.

Specifically, the liquid supply device illustrated in FIG. 10 includes the main tank 1, the multiple liquid discharge heads 100*a* and 100*b*, the multiple collection sub tanks 2*a* and 2*b*, the multiple supply sub tanks 3*a* and 3*b*, the plurality of positive pressure air tanks 10*a* and 10*b*, and the plurality of negative pressure air tanks 9*a* and 9*b*. The positive pressure air tank 10*a* is connected to the supply sub tanks 3*a* and 3*b*, and the positive pressure air tank 10*b* is indirectly connected to the supply sub tanks 3*a* and 3*b* via the positive pressure air tank 10*a*. The negative pressure air tank 9*a* is connected to the collection sub tanks 2*a* and 2*b*, and the negative pressure air tank 9*b* is indirectly connected to the collection sub tanks 2*a* and 2*b* via the negative pressure air tank 9*a*.

The liquid supply device illustrated in FIG. 10 further includes the circulation flow paths 14*a* and 14*b*, the liquid circulation pumps 5*a* and 5*b*, the collection flow paths 12*a* and 12*b*, and the supply flow paths 13*a* and 13*b*. The circulation flow path 14*a* connects the supply sub tank 3*a* and the collection sub tank 2*a*. The circulation flow path 14*b* connects the supply sub tank 3*b* and the collection sub tank 2*b*. The liquid circulation pump 5*a* feeds liquid from the collection sub tank 2*a* to the supply sub tank 3*a*. The liquid circulation pump 5*b* feeds liquid from the collection sub tank 2*b* to the supply sub tank 3*b*. The collection flow path 12*a* connects the collection sub tank 2*a* and the liquid discharge head 100*a*. The collection flow path 12*b* connects the collection sub tank 2*b* and the liquid discharge head 100*b*. The supply flow path 13*a* connects the supply sub tank 3*a* and the liquid discharge head 100*a*. The supply flow path 13*b* connects the supply sub tank 3*b* and the liquid discharge head 100*b*.

The liquid supply device illustrated in FIG. 10 further includes the first negative pressure air path 15, the negative pressure air pump 7, the second negative pressure air path 17, a third negative pressure air path 19, the first positive pressure air path 16, the positive pressure air pump 6, the second positive pressure air path 18, and a third positive pressure air path 20. The first negative pressure air path 15 connects the collection sub tanks 2*a* and 2*b* and the negative pressure air tank 9*a*. The negative pressure air pump 7 depressurizes the negative pressure air tanks 9*b* (and 9*a*). The second negative pressure air path 17 communicates with the negative pressure air tank 9*b* and is connected to the negative pressure air pump 7. The third negative pressure air path 19 connects the negative pressure air tanks 9*a* and 9*b*. The first positive pressure air path 16 connects the supply sub tanks 3*a* and 3*b* and the positive pressure air tank 10*a*. The positive pressure air pump 6 pressurizes the positive pressure air tanks 10*b* (and 10*a*). The second positive pressure air path 18 communicates with the positive pressure air tank 10*b* and is connected to the positive pressure air pump 6. The third positive pressure air path 20 connects the positive pressure air tanks 10*a* and 10*b*.

As described above, even when the multiple sub tanks are provided, the plurality of air tanks connected to the multiple sub tanks can greatly increases the air volume (apparent air volume) in each sub tank. Therefore, the large air damper effect can be obtained, thereby reducing the pressure change range when the liquid is discharged by the liquid discharge head and the pressure pulsation range when the liquid is circulated by the pumps.

Figure 11:
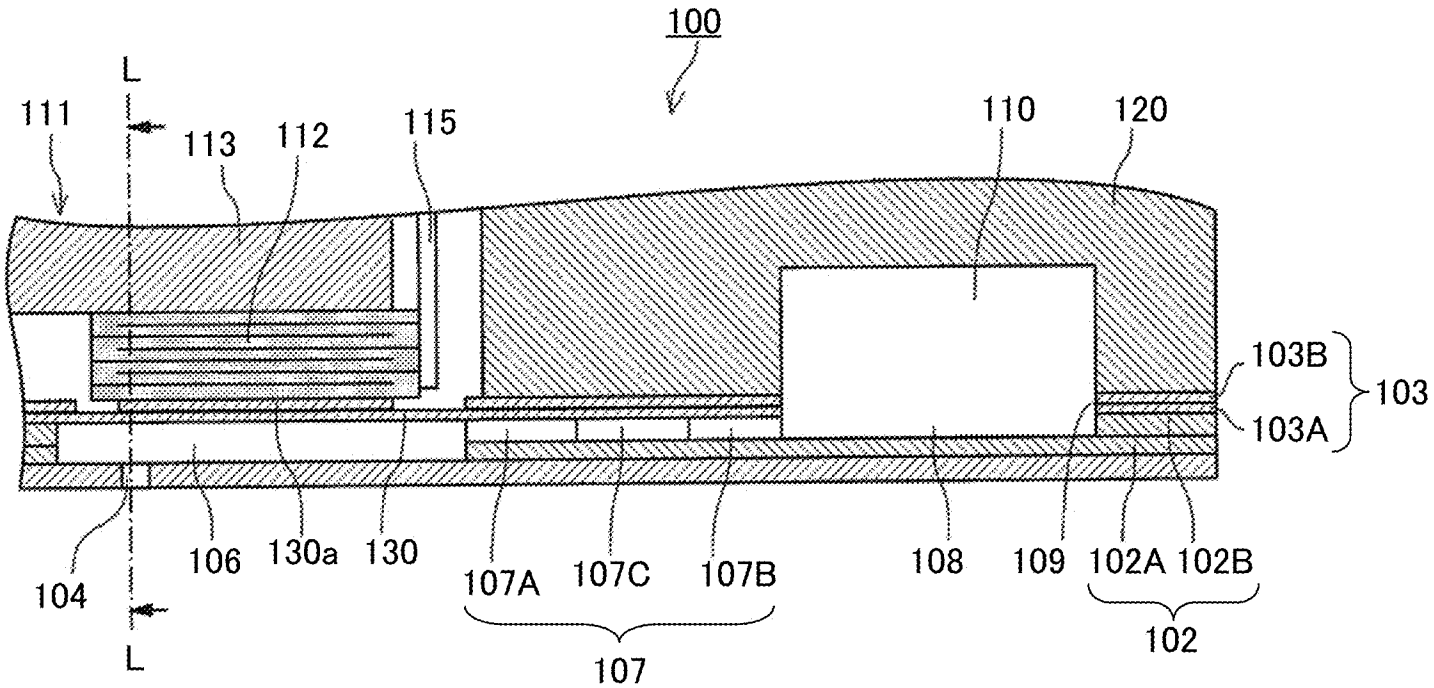
FIG. 11 is a cross-sectional view of a liquid discharge head in a direction perpendicular to a nozzle array direction according to embodiments of the present disclosure.
Figure 12:
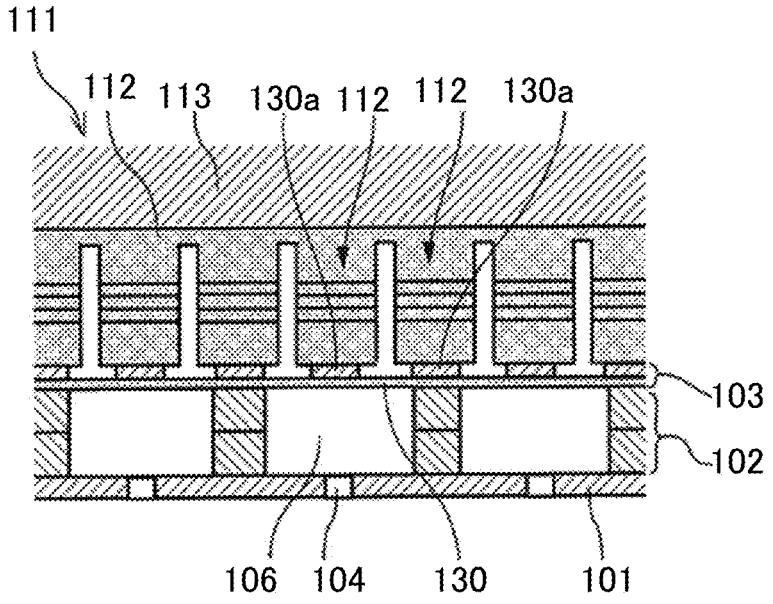
FIG. 12 is a cross-sectional view of the liquid discharge head in the nozzle array direction.

The liquid discharge head 100 is described with reference to FIGS. 11 and 12. The above-described liquid supply device according to the embodiments of the present disclosure supplies liquid to the liquid discharge head 100. FIG. 11 is a cross-sectional view of the liquid discharge head 100 in a direction (pressure-chamber longitudinal direction) perpendicular to a nozzle arrangement direction of the liquid discharge head 100 according to the above embodiments. FIG. 12 is a cross-sectional view of the liquid discharge head 100 in the nozzle arrangement direction along line L-L in FIG. 11.

The liquid discharge head 100 illustrated in FIGS. 11 and 12 includes a nozzle plate 101, a channel plate 102 as an individual channel member, and a diaphragm 103 as a wall member that are laminated one on another and bonded to each other. The channel plate 102 has a configuration in which plate members 102A and 102B are laminated one on another. The liquid discharge head 100 further includes a piezoelectric actuator 111 to displace a vibration portion (vibration plate) 130 of the diaphragm 103 and a common channel member 120 that also serves as a frame of the liquid discharge head 100.

The nozzle plate 101 includes a plurality of nozzles 104 to discharge liquid. The channel plate 102 forms a plurality of pressure chambers 106 communicating with the plurality of nozzles 104, a plurality of individual supply channels 107 that are individual channels communicating with the respective pressure chambers 106, and a plurality of intermediate supply channels 108 that are liquid introduction portions each communicating with one or the plurality of individual supply channels 107 (e.g., one individual supply channel in the present embodiment).

The diaphragm 103 includes a plurality of displaceable vibration portions (vibration plates) 130 that form walls of the pressure chambers 106 of the channel plate 102. The diaphragm 103 has a two-layer structure (not limited), and is constructed of a first layer 103A forming a thin portion and a second layer 103B forming a thick portion from the channel plate 102 side. The deformable vibration portions 130 are formed in a portion corresponding to the pressure chambers 106 in the first layer 103A serving as the thin portion. In the vibration portion 130, a convex portion 130*a* is formed as the thick portion joined to the piezoelectric actuator 111 in the second layer 103B.

The piezoelectric actuator 111 including an electromechanical transducer element serving as a driving device (an actuator device or a pressure generator device) to deform the vibration portion 130 of the diaphragm 103 is disposed on a side of the diaphragm 103 opposite a side facing the pressure chamber 106. In the piezoelectric actuator 111, a piezoelectric member bonded on a base 113 is grooved by half-cut dicing, to form a desired number of columnar piezoelectric elements 112 at predetermined intervals in a comb shape in the nozzle array direction. The piezoelectric element 112 is bonded to the convex portion 130*a* that is the thick portion in the vibration portion 130 of the diaphragm 103. The piezoelectric element 112 includes piezoelectric layers and internal electrodes alternately laminated on each other. Each internal electrode is led out to an end face and connected to an external electrode (end face electrode). The external electrode is connected to a flexible wiring 115.

The common channel member 120 forms a common supply channel 110 communicating with the plurality of pressure chambers 106. The common supply channel 110 communicates with the intermediate supply channel 108 as a liquid introduction portion via an opening 109 provided in the diaphragm 103 and communicates with the individual supply channel 107 via the intermediate supply channel 108.

In the liquid discharge head 100, for example, the voltage to be applied to the piezoelectric element 112 is lowered from a reference potential (intermediate potential) so that the piezoelectric element 112 contracts to pull the vibration portion 130 of the diaphragm 103 to increase the volume of the pressure chamber 106. As a result, liquid flows into the pressure chamber 106. Then, the voltage to be applied to the piezoelectric element 112 is increased to expand the piezoelectric element 112 in the direction of lamination, and the vibration portion 130 of the diaphragm 103 is deformed in a direction toward the nozzle 104 to reduce the volume of the pressure chamber 106. As a result, the liquid in the pressure chamber 106 is pressurized and discharged from the nozzle 104.

Figure 13:
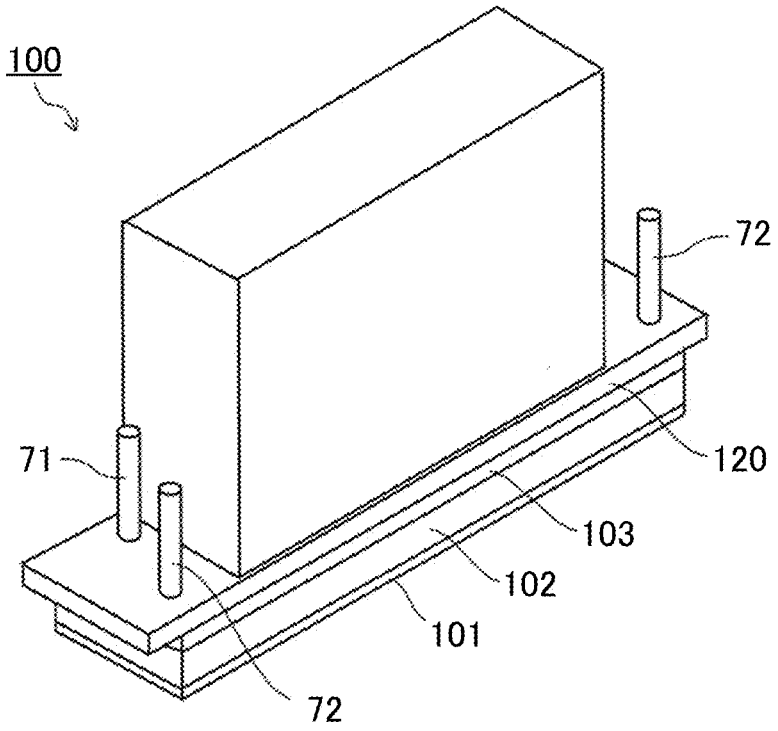
FIG. 13 is an exterior perspective view of the liquid discharge head.
Figure 14:
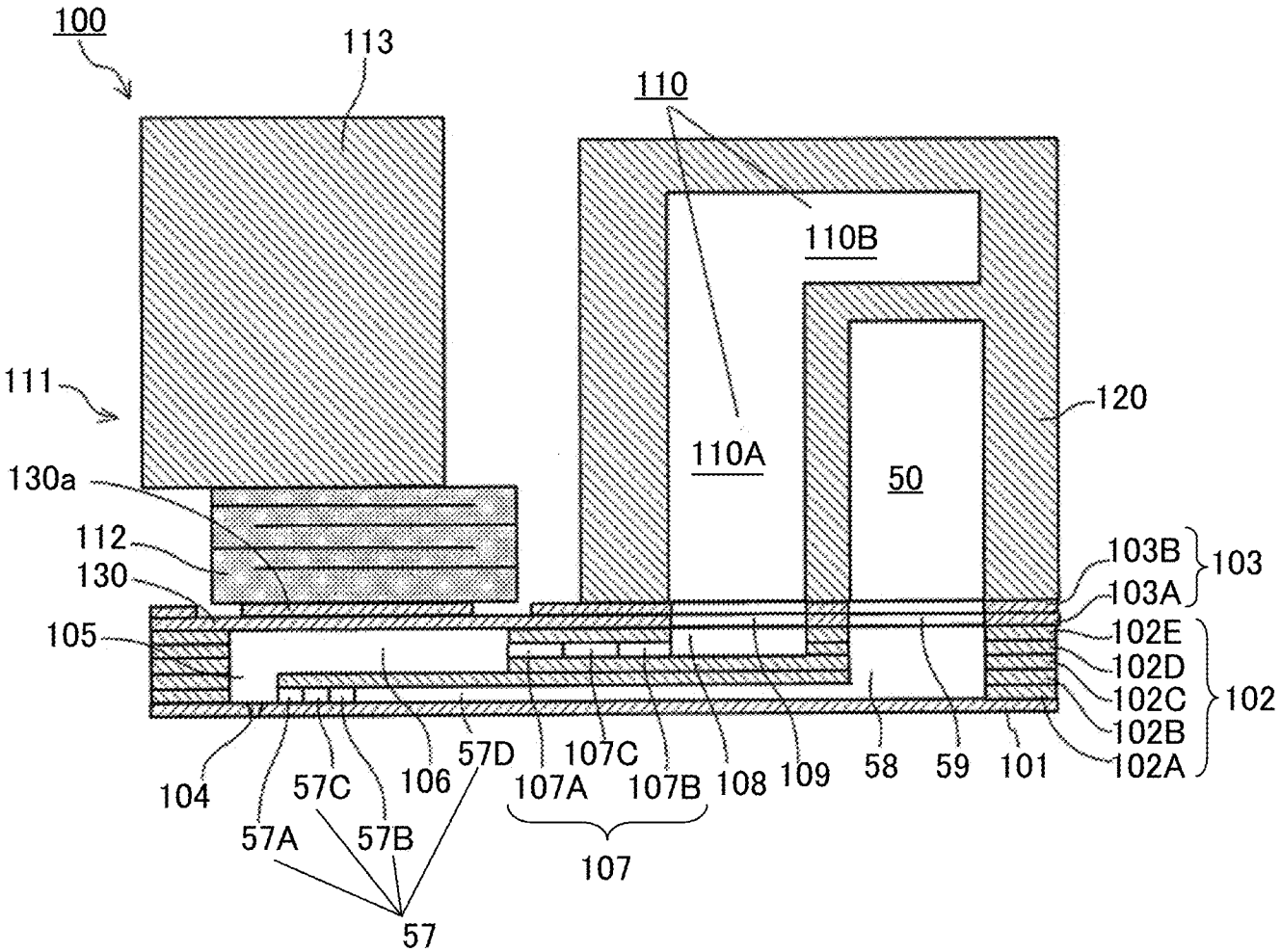
FIG. 14 is a cross-sectional view of the liquid discharge head in the direction perpendicular to the nozzle array direction.

Next, another example of the liquid discharge head 100 is described with reference to FIGS. 13 and 14. FIG. 13 is an exterior perspective view of the liquid discharge head 100. FIG. 14 is a cross-sectional view of the liquid discharge head 100 according to the present embodiment in the direction (pressure-chamber longitudinal direction) perpendicular to the nozzle arrangement direction of the liquid discharge head 100.

The liquid discharge head 100 illustrated in FIGS. 13 and 14 is a circulation type liquid discharge head, and includes the nozzle plate 101, the channel plate 102, and the diaphragm 103 as a wall member, which are laminated one on another and bonded to each other. The liquid discharge head 100 further includes the piezoelectric actuator 111 to displace the vibration portion (vibration plate) 130 of the diaphragm 103 and the common channel member 120 that also serves as a frame of the liquid discharge head 100.

The channel plate 102 forms the plurality of pressure chambers 106 communicating with the plurality of nozzles 104 via nozzle communication passages 105, the individual supply channels 107 also serving as a plurality of fluid restrictors communicating with the plurality of pressure chambers 106, and the intermediate supply channels 108 serving as one or a plurality of liquid introduction portions communicating with two or more individual supply channels 107. Similarly to the above-described embodiment, the individual supply channel 107 includes two channel portions, i.e., a first channel portion 107A and a second channel portion 107B having a higher fluid resistance than the pressure chamber 106, and a third channel portion 107C disposed between the first channel portion 107A and the second channel portion 107B and having a lower fluid resistance than each of the first channel portion 107A and the second channel portion 107B. The channel plate 102 has a configuration in which a plurality of plate members 102A to 102E are laminated one on another. However, the configuration of the channel plate is not limited thereto.

Further, the channel plate 102 forms a plurality of individual collection channels 57 and a plurality of intermediate collection channels 58. The individual collection channels 57 are formed along the surface direction of the channel plate 102 that respectively communicate with the plurality of pressure chambers 106 via the nozzle communication passages 105. The intermediate collection channels 58 serve as one or a plurality of liquid lead-out portions that communicates with two or more individual collection channels 57. The individual collection channel 57 includes two channel portions, i.e., a first channel portion 57A and a second channel portion 57B having a higher fluid resistance than the pressure chamber 106, and a third channel portion 57C disposed between the first channel portion 57A and the second channel portion 57B and having a lower fluid resistance than each of the first channel portion 57A and the second channel portion 57B. In the individual collection channel 57, a channel portion 57D downstream from the second channel portion 57B in the direction of circulation of the liquid has the same channel width as the third channel portion 57C.

The common channel member 120 forms the common supply channel 110 and a common collection channel 50. In the example illustrated in FIG. 14, the common supply channel 110 includes a channel portion 110A that is disposed side by side with the common collection channel 50 in the nozzle arrangement direction and a channel portion 110B that is not disposed side by side with the common collection channel 50. The common supply channel 110 communicates with the intermediate supply channel 108 as a liquid introduction portion via the opening 109 provided in the diaphragm 103 and communicates with the individual supply channel 107 via the intermediate supply channel 108. The common collection channel 50 communicates with the intermediate collection channel 58 as a liquid lead-out portion via an opening 59 provided in the diaphragm 103 and communicates with the individual collection channel 57 via the intermediate collection channel 58. The common supply channel 110 communicates with a supply port 71. The common collection channel 50 communicates with a collection port 72.

The layer structure of the diaphragm 103 and the structure of the piezoelectric actuator 111 are the same as those in the aspect illustrated in FIGS. 11 and 12. Also in this liquid discharge head 100, the piezoelectric element 112 is expanded in the direction of lamination, and the vibration portion 130 of the diaphragm 103 is deformed in the direction toward the nozzle 104 to reduce the volume of the pressure chamber 106. As a result, liquid in the pressure chamber 106 is pressurized and discharged from the nozzle 104.

The liquid not discharged from the nozzle 104 passes the nozzle 104, is collected from the individual collection channel 57 to the common collection channel 50, and is supplied again to the common supply channel 110 through an external circulation passage from the common collection channel 50. In addition, even when the liquid is not discharged from the nozzle 104, the liquid circulates from the common supply channel 110 to the common collection channel 50 through the pressure chamber 106 and is supplied again to the common supply channel 110 through the external circulation passage.

Accordingly, also in the present embodiment, the pressure fluctuation accompanying liquid discharge can be attenuated with a simple configuration, thus restraining propagation of the pressure fluctuation to the common supply channel 110 and the common collection channel 50.

Figure 15:
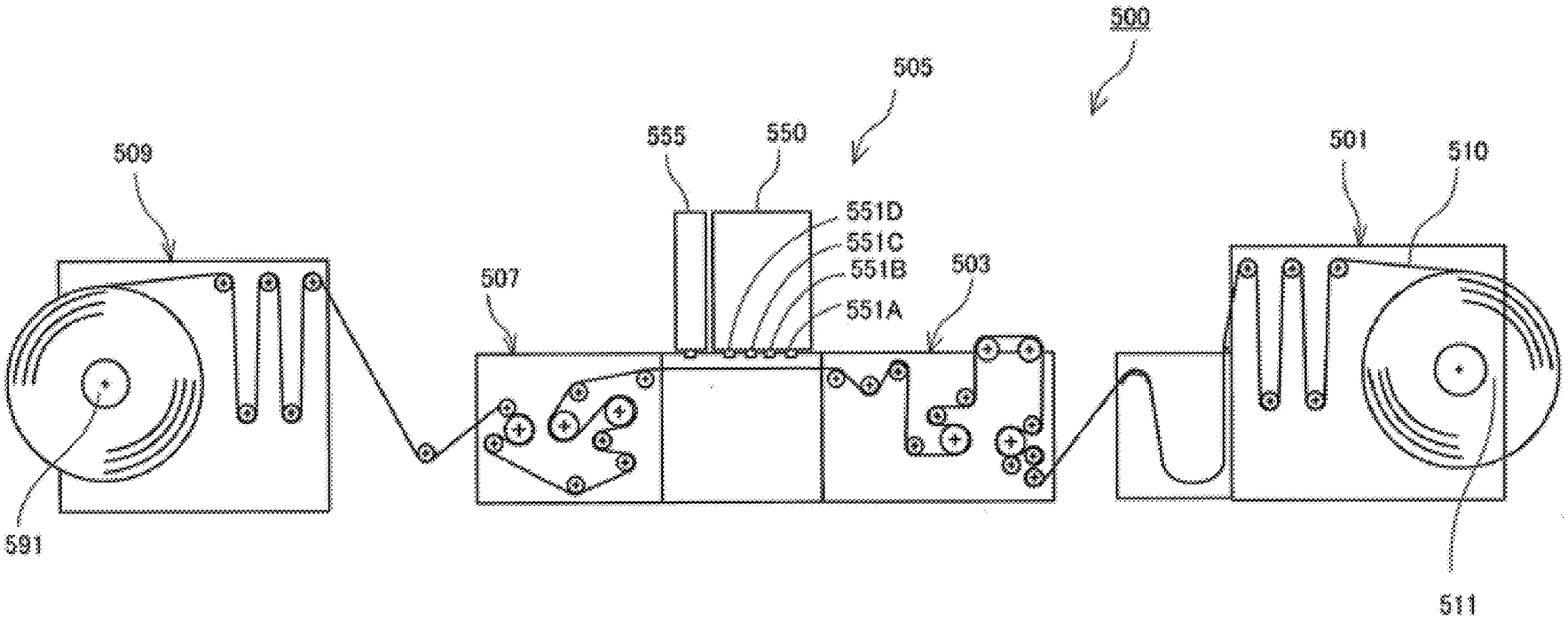
FIG. 15 is a schematic view of a liquid discharge apparatus according to embodiments of the present disclosure.
Figure 16:
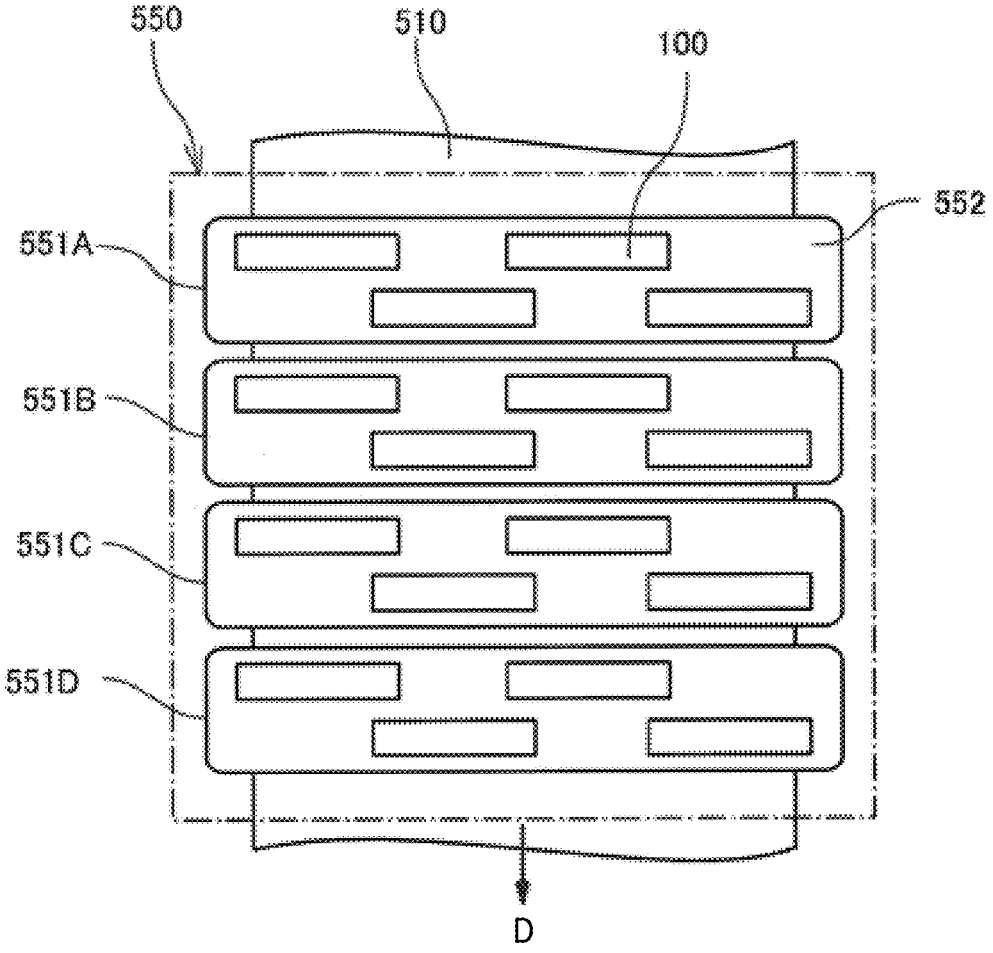
FIG. 16 is a plan view of a head unit included in the liquid discharge apparatus illustrated in FIG. 15.

Next, an example of a liquid discharge apparatus according to the present embodiment is described with reference to FIGS. 15 and 16. FIG. 15 is a schematic view of the liquid discharge apparatus. FIG. 16 is a plan view of a head unit of the liquid discharge apparatus. The liquid discharge apparatus according to the present disclosure includes the above-described liquid supply device according to the present disclosure.

A printing apparatus 500 serving as the liquid discharge apparatus according to the present embodiment includes, e.g., a feeder 501, a guide conveyor 503, a printer 505, a drier 507, and a carrier 509. The feeder 501 feeds a continuous medium 510 inward. The guide conveyor 503 guides and conveys the continuous medium 510 such as a continuous sheet of paper or a sheet medium fed inward from the feeder 501. The printer 505 performs printing by discharging liquid onto the continuous medium 510 to form an image. The drier 507 dries the continuous medium 510 with the image formed. The carrier 509 feeds the dried continuous medium 510 outward.

The continuous medium 510 is fed from a winding roller 511 of the feeder 501, guided and conveyed with rollers of the feeder 501, the guide conveyor 503, the drier 507, and the carrier 509, and wound around a take-up roller 591 of the carrier 509. In the printer 505, the continuous medium 510 is conveyed on a conveyance guide so as to face a head unit 550 and a head unit 555. An image is formed with liquid discharged from the head unit 550, and post-treatment is performed with treatment liquid discharged from the head unit 555.

Here, the head unit 550 includes, for example, full-line head arrays 551A, 551B, 551C, and 551D for four colors from the upstream side in a conveyance direction of the continuous medium 510 indicated by arrow D in FIG. 16. Hereinafter, the full-line head arrays 551A, 551B, 551C, and 551D are simply referred to as the "head array 551" when colors are not distinguished. Each of the head arrays 551 is a liquid discharger to discharge liquid of black (K), cyan (C), magenta (M), or yellow (Y) onto the continuous medium 510 conveyed along the conveyance direction of the continuous medium 510. Note that the number and types of colors are not limited to the above-described four colors of K, C, M, and Y and may be any other suitable number and types. In the head array 551, for example, the liquid discharge heads 100 according to above-described embodiments of the present disclosure are arranged in a staggered manner on a base 552 as illustrated in FIG. 16. Note that embodiments of the present disclosure are not limited to the arrangement and may be any other suitable head arrangement.

Figure 17:
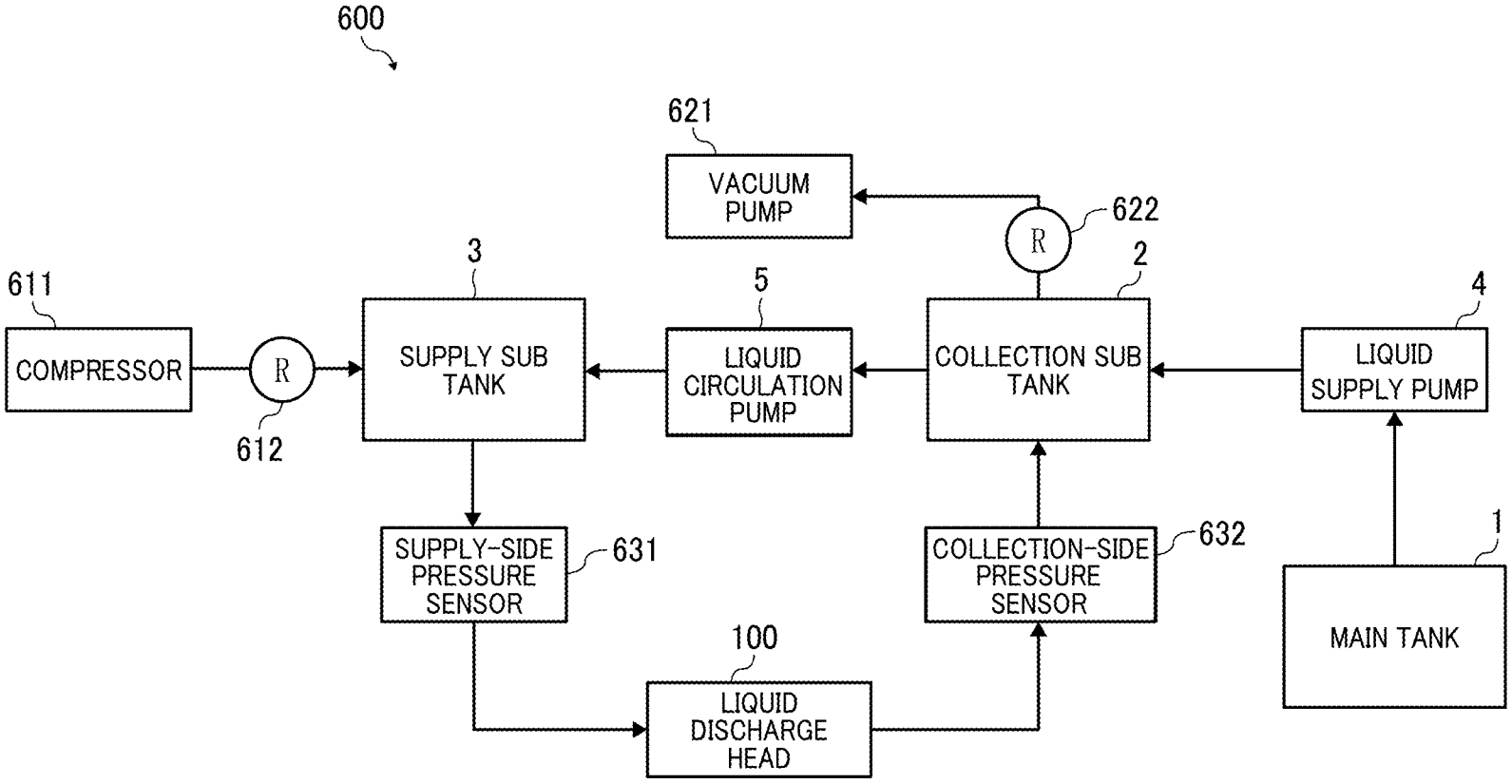
FIG. 17 is a block diagram of a liquid circulation device included in the liquid supply device.

FIG. 17 is a block diagram of a liquid circulation device 600 included in the liquid supply device. Although only one liquid discharge head 100 is illustrated in FIG. 17, in the structure including a plurality of liquid discharge heads 100 as illustrated in FIG. 16, a plurality of supply flow paths 13 and a plurality of collection flow paths 12 are respectively connected via manifolds or the like to the supply sides and collection sides of the plurality of liquid discharge heads 100. The liquid circulation device 600 includes the supply sub tank 3, the collection sub tank 2, the main tank 1, the liquid circulation pump (first liquid-feed pump) 5, the liquid supply pump (second liquid-feed pump) 4, a compressor 611, a regulator 612, a vacuum pump 621, a regulator 622, a supply-side pressure sensor 631, and a collection-side pressure sensor 632, for example.

The compressor 611 and the vacuum pump 621 together generate a difference between the pressure in the supply sub tank 3 and the pressure in the collection sub tank 2. The compressor 611 may include the positive pressure air tank 10 and can apply positive air pressure to the supply sub tank 3. The vacuum pump 621 may include the negative pressure air tank 9 and can apply negative air pressure to the collection sub tank 2. The supply-side pressure sensor 631 is disposed between the supply sub tank 3 and the liquid discharge head 100 and coupled to the supply flow path 13 connected to the supply port 71 of the liquid discharge head 100. The collection-side pressure sensor 632 is disposed between the liquid discharge head 100 and the collection sub tank 2 and coupled to the collection flow path 12 connected to the collection port 72 of the liquid discharge head 100.

One side of the collection sub tank 2 is connected to the supply sub tank 3 via the liquid circulation pump 5, and the other side of the collection sub tank 2 is connected to the main tank 1 via the liquid supply pump 4. Accordingly, liquid flows into the liquid discharge head 100 from the supply sub tank 3 through the supply port 71, is collected to the collection sub tank 2 through the collection port 72, and is sent from the collection sub tank 2 to the supply sub tank 3 by the liquid circulation pump 5, thereby forming a circulation path through which the liquid circulates.

Here, the compressor 611 is connected to the supply sub tank 3 and is controlled so that a predetermined positive pressure is detected by the supply-side pressure sensor 631. On the other hand, the vacuum pump 621 is connected to the collection sub tank 2 and is controlled so that a predetermined negative pressure is detected by the collection-side pressure sensor 632. Such a configuration allows the meniscus of liquid to be maintained at a constant negative pressure while circulating the liquid through the liquid discharge head 100.

When liquid is discharged from the nozzles 104 of the liquid discharge head 100, the amount of liquid in the supply sub tank 3 and the collection sub tank 2 decreases. Therefore, the liquid supply pump 4 appropriately replenishes liquid from the main tank 1 to the collection sub tank 2. The timing of liquid replenishment from the main tank 1 to the collection sub tank 2 can be controlled based on, for example, the detection result of a liquid level sensor provided in the collection sub tank 2. In such a case, for example, the liquid replenishment may be performed when the liquid level of the liquid in the collection sub tank 2 falls below a predetermined height.

Figure 18:
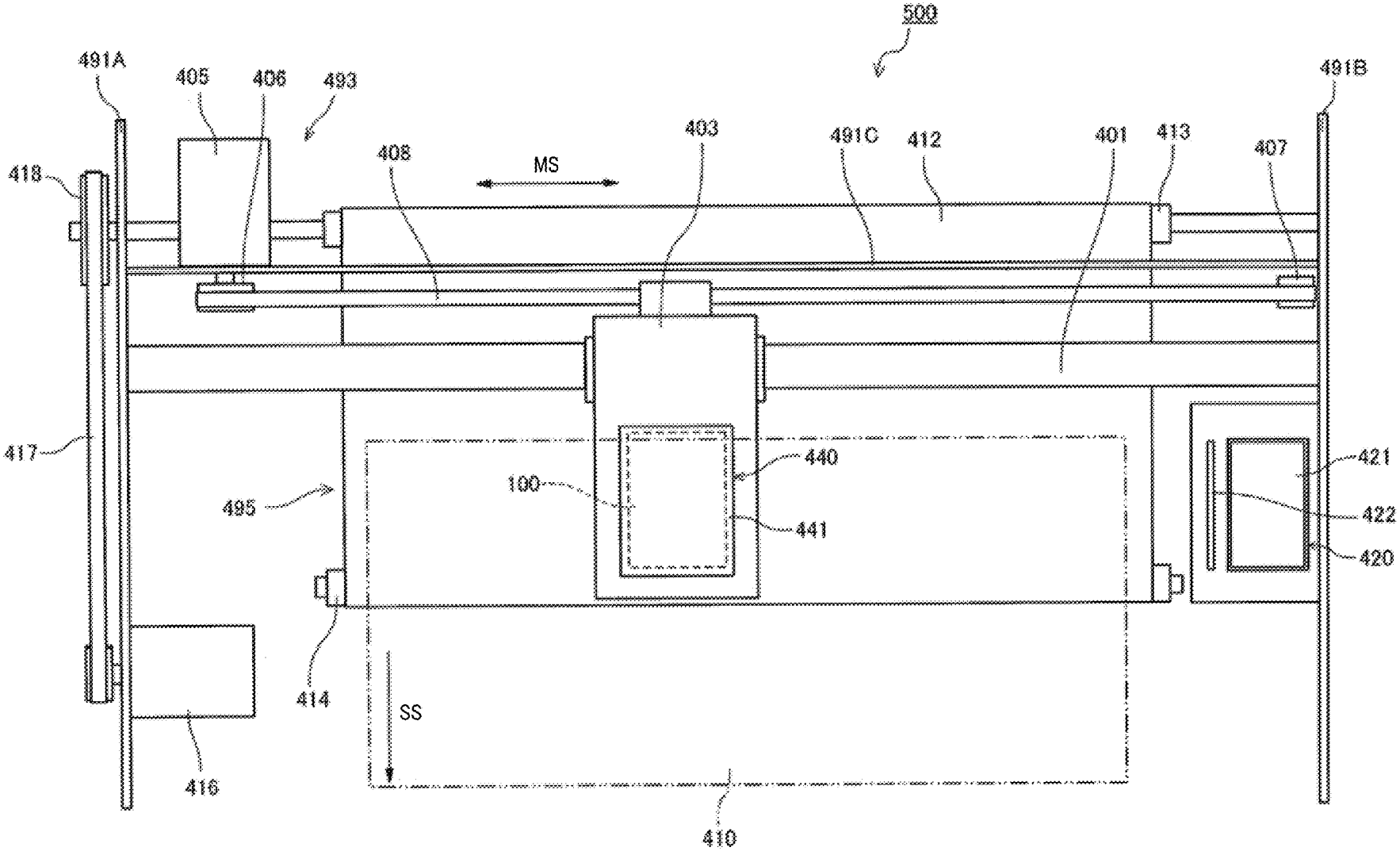
FIG. 18 is a plan view of a part of the liquid discharge apparatus.
Figure 19:
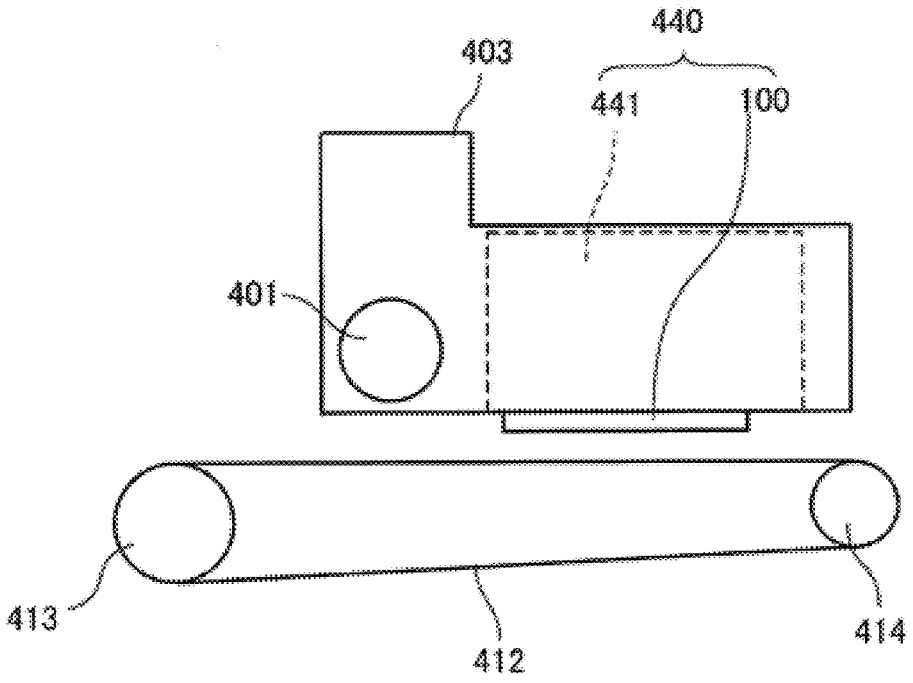
FIG. 19 is a side view of a part of the liquid discharge apparatus.

Next, another example of the printing apparatus 500 as the liquid discharge apparatus according to the present disclosure is described with reference to FIGS. 18 and 19. FIG. 18 is a plan view of a part of the printing apparatus 500. FIG. 19 is a side view of the part of the printing apparatus 500.

The printing apparatus 500 is a serial type apparatus, and a main-scanning moving mechanism 493 reciprocally moves a carriage 403 in the main scanning direction indicated by arrow MS in FIG. 18. The main-scanning moving mechanism 493 includes, e.g., a guide 401, a main-scanning motor 405, and a timing belt 408. The guide 401 is bridged between left and right side plates 491A and 491B to moveably hold the carriage 403. The main-scanning motor 405 reciprocates the carriage 403 in the main scanning direction via the timing belt 408 looped around a drive pulley 406 and a driven pulley 407. The carriage 403 carries a liquid discharge device 440 according to the present disclosure including the liquid discharge head 100 and a head tank 441 as a single integrated unit. The liquid discharge device 440 includes the above-described liquid circulation device 600 as the liquid supply device according to the present disclosure.

The liquid discharge head 100 of the liquid discharge device 440 discharges color liquid of, for example, yellow (Y), cyan (C), magenta (M), or black (K). The liquid discharge head 100 includes a nozzle array including the plurality of nozzles 104 arrayed in row in the sub-scanning direction indicated by arrow SS perpendicular to the main scanning direction indicated by arrow MS in FIG. 16. The liquid discharge head 100 is mounted to the carriage 403 so that liquid is discharged downward from the nozzles 104. The liquid discharge head 100 is connected to the liquid circulation device 600 described above so that liquid of a required color is circulated and supplied.

The printing apparatus 500 includes a conveyance mechanism 495 to convey a sheet 410. The conveyance mechanism 495 includes a conveyance belt 412 as a conveyor and a sub-scanning motor 416 to drive the conveyance belt 412. The conveyance belt 412 attracts the sheet 410 and conveys the sheet 410 at a position facing the liquid discharge head 100. The conveyance belt 412 is an endless belt stretched between a conveyance roller 413 and a tension roller 414. The sheet 410 can be attracted to the conveyance belt 412 by electrostatic attraction, air suction, or the like. The conveyance belt 412 circumferentially moves in the sub-scanning direction as the conveyance roller 413 is rotationally driven by the sub-scanning motor 416 via a timing belt 417 and a timing pulley 418.

On one side of the carriage 403 in the main scanning direction, a maintenance mechanism 420 that maintains and recovers the liquid discharge head 100 is disposed lateral to the conveyance belt 412. The maintenance mechanism 420 includes, for example, a cap 421 to cap a nozzle face (i.e., a face on which nozzles are formed) of the liquid discharge head 100 and a wiper 422 to wipe the nozzle face.

The main-scanning moving mechanism 493, the maintenance mechanism 420, and the conveyance mechanism 495 are mounted onto a housing including the side plates 491A and 491B and a back plate 491C. In the printing apparatus 500 having the above-described configuration, the sheet 410 is fed and attracted onto the conveyance belt 412 and conveyed in the sub-scanning direction by the circumferential movement of the conveyance belt 412. The liquid discharge head 100 is driven in response to image signals while the carriage 403 moves in the main scanning direction to discharge liquid to the sheet 410 not in motion, thus forming an image on the sheet 410.

Figure 20:
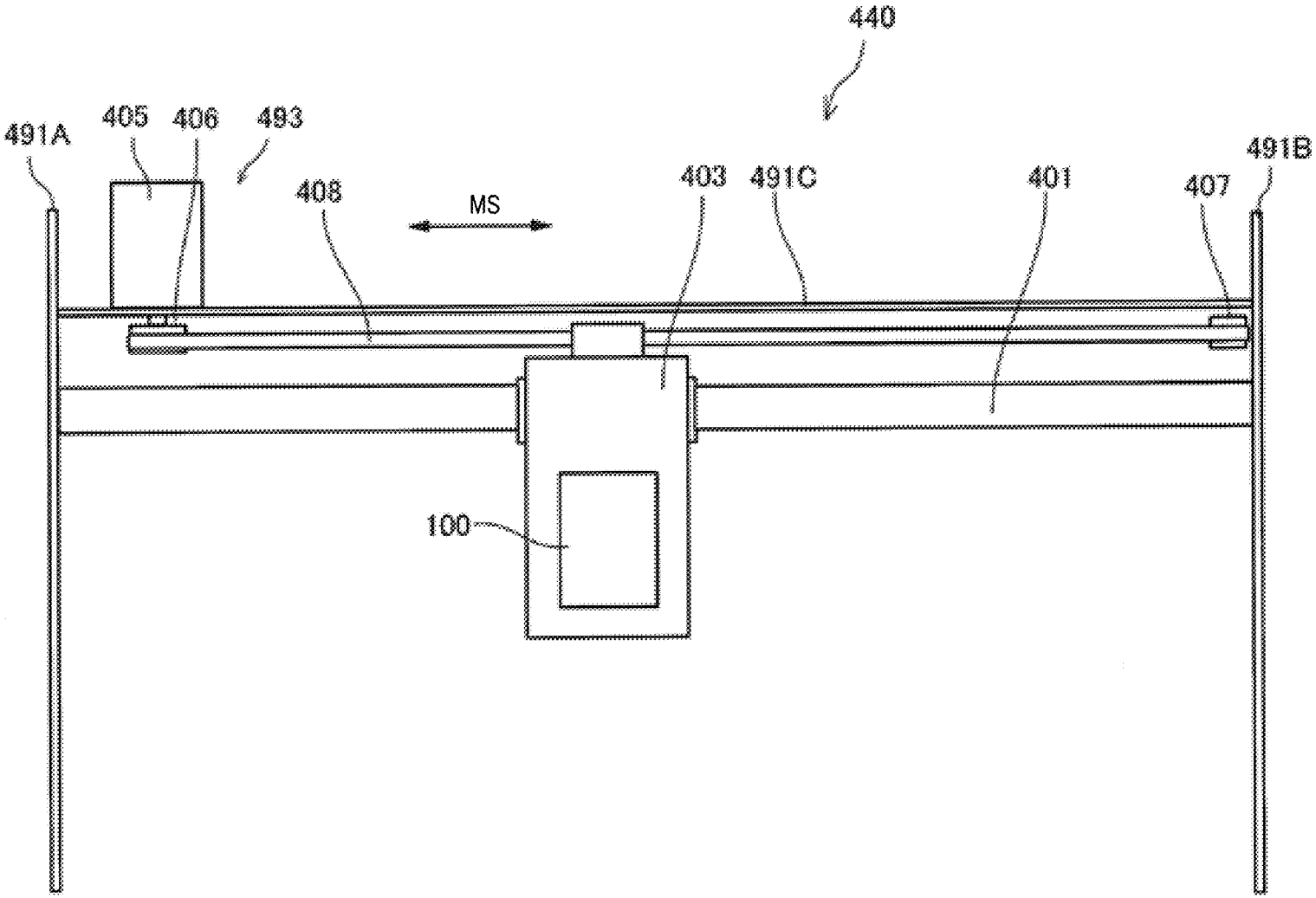
FIG. 20 is a plan view of a part of a liquid discharge device of the liquid discharge apparatus.

Next, the liquid discharge device 440 according to another embodiment of the present disclosure is described with reference to FIG. 20. FIG. 20 is a plan view of a part of the liquid discharge device 440. The liquid discharge device 440 includes the above-described liquid circulation device 600 according to the present disclosure. The liquid discharge device 440 includes a housing, the main-scanning moving mechanism 493, the carriage 403, and the liquid discharge head 100 among components of the liquid discharge apparatus. The side plates 491A and 491B, and the back plate 491C construct the housing. Note that, in the liquid discharge device 440, the maintenance mechanism 420 described above may be mounted on, for example, the side plate 491B.

Figure 21:
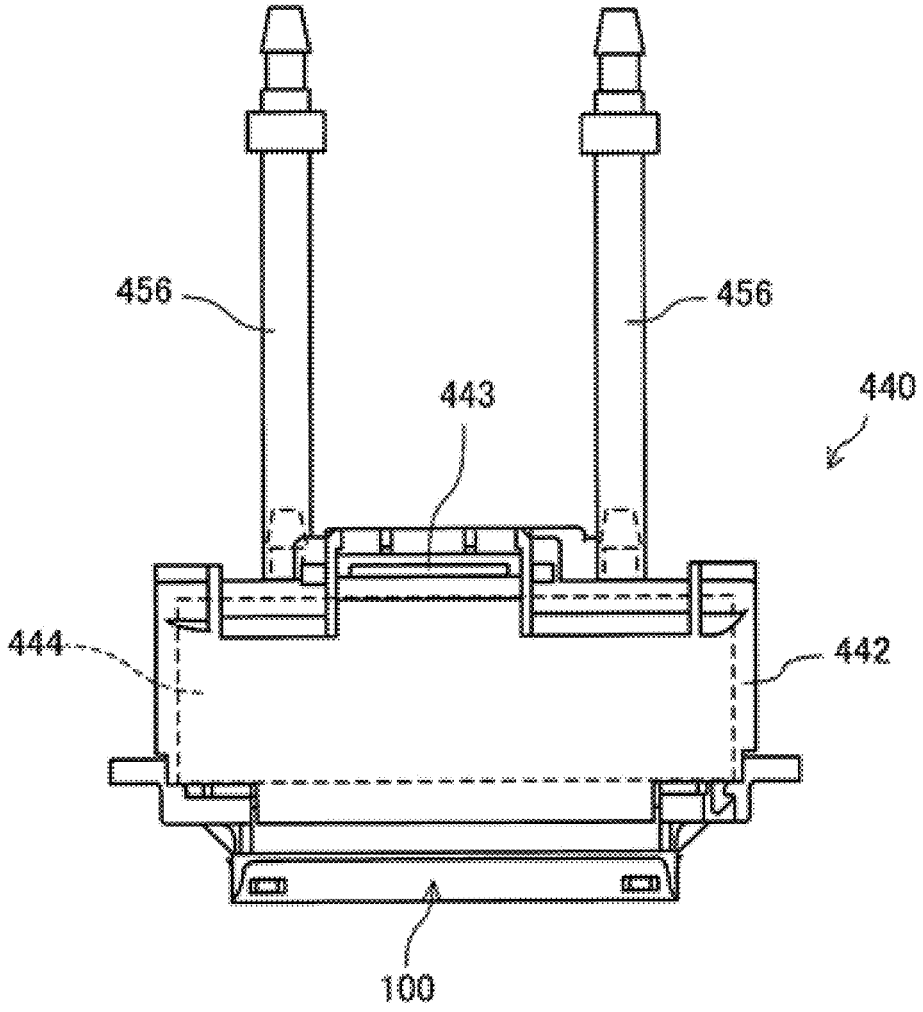
FIG. 21 is a front view of a part of the liquid discharge device.

Next, still another example of the liquid discharge device 440 according to the present disclosure is described with reference to FIG. 21. FIG. 21 is a front view of the liquid discharge device 440. The liquid discharge device 440 includes the liquid discharge head 100 to which a channel component 444 is attached, and a tube 456 connected to the channel component 444. The liquid discharge device 440 may further include the above-described liquid circulation device 600 according to the present disclosure. The channel component 444 is disposed inside a cover 442. In some embodiments, the liquid discharge device 440 may include the head tank 441 instead of the channel component 444. A connector 443 for electrically connecting to the liquid discharge head 100 is provided on the channel component 444.

In the present disclosure, the liquid to be discharged is not limited to a particular liquid as long as the liquid has a viscosity or surface tension to be discharged from a head (liquid discharge head). However, preferably, the viscosity of the liquid is not greater than 30 mPa·s under ordinary temperature and ordinary pressure or by heating or cooling. Examples of the liquid include a solution, a suspension, or an emulsion including, for example, a solvent, such as water or an organic solvent, a colorant, such as dye or pigment, a functional material, such as a polymerizable compound, a resin, a surfactant, a biocompatible material, such as DNA, amino acid, protein, or calcium, and an edible material, such as a natural colorant. Such a solution, a suspension, or an emulsion can be used for, e.g., inkjet ink; surface treatment liquid; a liquid for forming an electronic element component, a light-emitting element component, or an electronic circuit resist pattern; or a material solution for three-dimensional fabrication.

Examples of an energy source for generating energy to discharge liquid include a piezoelectric actuator (a laminated piezoelectric element or a thin-film piezoelectric element), a thermal actuator that employs a thermoelectric conversion element, such as a thermal resistor, and an electrostatic actuator including a diaphragm and opposed electrodes.

The "liquid discharge device" is an assembly of parts relating to liquid discharge. The term "liquid discharge device" represents a structure including the liquid discharge head and a functional part(s) or unit(s) combined with the liquid discharge head as a single unit. For example, the "liquid discharge device" includes a combination of the liquid discharge head with at least one of a head tank, a carriage, a supply mechanism, a maintenance mechanism, a main-scanning moving mechanism, and a liquid circulation device.

Here, examples of the "single unit" include a combination in which the liquid discharge head and a functional part(s) or unit(s) are secured to each other through, e.g., fastening, bonding, or engaging, and a combination in which one of the liquid discharge head and a functional part(s) or unit(s) is movably held by another. The liquid discharge head may be detachably attached to the functional part(s) or unit(s) each other.

For example, the liquid discharge head and the head tank may form the liquid discharge device as a single unit. Alternatively, the liquid discharge head and the head tank coupled (connected) to each other via a tube or the like may form the liquid discharge device as a single unit. Here, a unit including a filter may further be added to a portion between the head tank and the liquid discharge head of the liquid discharge device.

In another example, the liquid discharge head and the carriage may form the liquid discharge device as a single unit.

In still another example, the liquid discharge device includes the liquid discharge head movably held by a guide that forms part of a main-scanning moving mechanism, so that the liquid discharge head and the main-scanning moving mechanism are integrated as a single unit. The liquid discharge device may include the liquid discharge head, the carriage, and the main-scanning moving mechanism that form a single unit.

In another example, a cap that is a part of the maintenance mechanism is secured to the carriage mounting the liquid discharge head so that the liquid discharge head, the carriage, and the maintenance mechanism are integrated as a single unit to form the liquid discharge device.

Further, in another example, the liquid discharge device includes a tube connected to the liquid discharge head mounting the head tank or the channel component so that the liquid discharge head and the supply mechanism form a single unit. Liquid is supplied from a liquid reservoir source to the liquid discharge head via the tube.

The main-scanning moving mechanism may be a guide only. The supply mechanism may be a tube(s) only or a loading device only.

The term "liquid discharge apparatus" used herein also represents an apparatus including the liquid discharge head or the liquid discharge device to drive the liquid discharge head to discharge liquid. The liquid discharge apparatus may be, for example, an apparatus capable of discharging liquid to a material onto which liquid can adhere or an apparatus to discharge liquid toward gas or into liquid.

The "liquid discharge apparatus" may include devices to feed, convey, and eject the material onto which liquid can adhere. The liquid discharge apparatus may further include a pretreatment apparatus to apply treatment liquid onto the material, and a post-treatment apparatus to apply treatment liquid onto the material.

The "liquid discharge apparatus" may be, for example, an image forming apparatus to form an image on a sheet by discharging ink, or a three-dimensional fabrication apparatus to discharge fabrication liquid to a powder layer in which powder material is formed in layers to form a three-dimensional fabrication object.

The liquid discharge apparatus is not limited to an apparatus to discharge liquid to visualize meaningful images, such as letters or figures. For example, the liquid discharge apparatus may be an apparatus to form arbitrary images, such as arbitrary patterns, or fabricate three-dimensional images.

The above-described term "material onto which liquid can adhere" represents a material onto which liquid at least temporarily adheres, a material onto which liquid adheres and is fixed, or a material onto which liquid adheres to permeate. Examples of the "material onto which liquid can adhere" include a recording medium such as a paper sheet, recording paper, and a recording sheet of paper, film, and cloth, electronic components such as an electronic substrate and a piezoelectric element, and a medium such as a powder layer, an organ model, and a testing cell. The "material onto which liquid can adhere" includes any material on which liquid adheres unless particularly limited. Examples of the "material onto which liquid can adhere" include any materials onto which liquid can adhere even temporarily, such as paper, thread, fiber, fabric, leather, metal, plastic, glass, wood, and ceramic.

The "liquid discharge apparatus" may be an apparatus to relatively move the liquid discharge head and a material onto which liquid can adhere. However, the liquid discharge apparatus is not limited to such an apparatus. For example, the liquid discharge apparatus may be a serial head apparatus that moves the liquid discharge head or a line head apparatus that does not move the liquid discharge head.

Examples of the "liquid discharge apparatus" further include a treatment liquid coating apparatus to discharge treatment liquid to a sheet to apply the treatment liquid onto a sheet surface to reform the sheet surface, and an injection granulation apparatus in which composition liquid including raw materials dispersed in a solution is injected through nozzles to granulate fine particles of the raw materials.

The terms "image formation", "recording", "printing", "image printing", and "fabricating" used in the present embodiments may be used synonymously with each other.

As described above, according to the present disclosure, the liquid supply device can be provided that reduces the size of the device including the circulatory mechanism.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

What is claimed is:

1. A liquid supply device comprising:

a collection sub tank configured to collect liquid from a liquid discharge head; and a collection flow path connecting the liquid discharge head and the collection sub tank, the collection sub tank including:

a first inflow port connected with the collection flow path; and a first inner wall portion on an extension line extending from the first inflow port in a direction in which the liquid flows into the collection sub tank from the collection flow path, the first inner wall portion having one of an inclined surface inclined with respect to the extension line, an arc-shaped surface, and a curved surface.

2. The liquid supply device according to claim 1, wherein the collection sub tank further includes:

an outflow port through which the liquid flows out of the collection sub tank; and a second inner wall portion on an extension line extending from the outflow port in a direction opposite to a direction in which the liquid flows out of the collection sub tank, the second inner wall portion having one of an inclined surface inclined with respect to the extension line, an arc-shaped surface, and a curved surface.

3. The liquid supply device according to claim 1, wherein the collection sub tank further includes:

a second inflow port through which the liquid flows into the collection sub tank; and a third inner wall portion on an extension line extending from the second inflow port in a direction in which the liquid flows into the collection sub tank through the second inflow port, the third inner wall portion having one of an inclined surface inclined with respect to the extension line, an arc-shaped surface, and a curved surface.

4. The liquid supply device according to claim 3, wherein the second inner wall portion and the third inner wall portion share a common area.

5. The liquid supply device according to claim 3, wherein the second inflow port is on the first inner wall portion.

6. The liquid supply device according to claim 1, further comprising:

a supply sub tank configured to supply liquid to the liquid discharge head; and a supply flow path connecting the liquid discharge head and the supply sub tank, wherein the supply sub tank includes:

an outflow port connected with the supply flow path; and a fourth inner wall portion on an extension line extending from the outflow port in a direction opposite to a direction in which the liquid flows out of the supply sub tank, the fourth inner wall portion having one of an inclined surface inclined with respect to the extension line, an arc-shaped surface, and a curved surface.

7. The liquid supply device according to claim 6, further comprising a circulation flow path connecting the supply sub tank and the collection sub tank, wherein the supply sub tank further includes:

an inflow port through which the liquid supplied from the collection sub tank flows into the supply sub tank; and a fifth inner wall portion on an extension line extending from the inflow port in a direction in which the liquid flows into the supply sub tank, the fifth inner wall portion having one of an inclined surface inclined with respect to the extension line, an arc-shaped surface, and a curved surface.

8. The liquid supply device according to claim 6, further comprising:

a main tank configured to store liquid to be supplied to the liquid discharge head;

a sub tank including the supply sub tank and the collection sub tank, the sub tank communicating with the main tank and the liquid discharge head, the sub tank configured to store at least gas; and an air tank connected to the sub tank and configured to store gas, the air tank including:

a positive pressure air tank connected to the supply sub tank and configured to apply positive air pressure to the supply sub tank; and a negative pressure air tank connected to the collection sub tank and configured to apply negative air pressure to the collection sub tank.

9. A liquid discharge device comprising:

a liquid discharge head configured to discharge liquid; and the liquid supply device according to claim 1, configured to supply the liquid to the liquid discharge head and collect the liquid from the liquid discharge head.

10. A liquid discharge apparatus comprising:

a liquid discharge head configured to discharge liquid; and the liquid supply device according to claim 1, configured to supply the liquid to the liquid discharge head and collect the liquid from the liquid discharge head.

* * * * *